US008573876B2

(12) United States Patent
Cheng et al.

(10) Patent No.: US 8,573,876 B2
(45) Date of Patent: Nov. 5, 2013

(54) SOFT CLOSE RING BINDER MECHANISM WITH MATING RING TIPS

(75) Inventors: Hung Yu Cheng, Hong Kong (CN); Ho Ping Cheng, Hong Kong (CN); Chun Yuen To, Hong Kong (CN)

(73) Assignee: World Wide Stationery Manufacturing Company, Limited, Kwai Chung (HK)

( * ) Notice: Subject to any disclaimer, the term of this patent is extended or adjusted under 35 U.S.C. 154(b) by 2728 days.

(21) Appl. No.: 11/080,710

(22) Filed: Mar. 15, 2005

(65) Prior Publication Data

US 2005/0207826 A1 Sep. 22, 2005

Related U.S. Application Data

(63) Continuation-in-part of application No. 10/967,882, filed on Oct. 18, 2004, and a continuation-in-part of application No. 10/870,165, filed on Jun. 17, 2004.

(60) Provisional application No. 60/553,155, filed on Mar. 15, 2004.

(30) Foreign Application Priority Data

Jun. 29, 2004 (CN) ..... 2004 1 0061917

(51) Int. Cl.

| | |
|---|---|
| ***B42F 3/02*** | (2006.01) |
| ***B42F 13/30*** | (2006.01) |
| ***B42F 3/00*** | (2006.01) |
| ***B42F 13/40*** | (2006.01) |
| ***B42F 13/20*** | (2006.01) |
| ***B42F 13/12*** | (2006.01) |
| ***B42F 13/36*** | (2006.01) |

(52) U.S. Cl.

USPC ..... 402/52; 402/5; 402/26; 402/41; 402/46; 402/49; 402/54; 402/56; 402/60; 402/61; 402/64

(58) Field of Classification Search

USPC ..... 402/5, 26, 40, 41, 46, 49, 52, 54, 56, 402/60, 61, 64

See application file for complete search history.

(56) References Cited

U.S. PATENT DOCUMENTS 566,717 A 8/1896 Krah
651,254 A 6/1900 Krah (Continued)

FOREIGN PATENT DOCUMENTS

EP 1431065 A2 6/2004
FR 1 336 765 7/1962

(Continued)

OTHER PUBLICATIONS

Office Action dated Jan. 3, 2008 from related U.S. Appl. No. 10/870,165, 14 pages.

(Continued)

*Primary Examiner* — Dana Ross
*Assistant Examiner* — Justin V Lewis
(74) *Attorney, Agent, or Firm* — Senniger Powers LLP

(57) ABSTRACT

A ring binder mechanism for retaining loose-leaf pages securely holds closed ring members together to prevent inadvertent loss of pages retained by the mechanism. The mechanism comprises a housing supporting two hinge plates for pivoting motion to open and close paired ring members mounted on the plates. Free ends of the paired ring members have interlocking configurations that securely join together when the ring members close. The configurations prevent misalignment of the closed ring members in all directions transverse to longitudinal centerlines of the ring members. The mechanism also includes locking elements that interact with the hinge plates to block their pivoting motion when the ring members are closed. This holds the free ends of the closed paired ring members together so that the interlocking configurations of the ring members remain interengaged.

18 Claims, 37 Drawing Sheets

(56) References Cited

U.S. PATENT DOCUMENTS 683,019 A 9/1901 Buchanan
692,584 A 2/1902 Adams
724,849 A 4/1903 Gresham
763,176 A 6/1904 Gresham et al.
778,992 A 1/1905 Nelson
792,389 A 6/1905 Boehner
812,397 A 2/1906 Boehner
840,949 A 1/1907 Mendenhall
842,851 A 2/1907 Boden
857,377 A 6/1907 Baker
901,076 A 10/1908 Dawson
904,618 A 11/1908 Kellner
936,448 A 10/1909 Hamacher
968,657 A 8/1910 Melchert
974,831 A 11/1910 Scherzinger
1,011,391 A 12/1911 Sturgis
1,020,561 A 3/1912 Krumming
1,105,196 A 7/1914 Hanke
1,163,179 A 12/1915 Schade, Jr.
1,165,766 A 12/1915 Elder
1,168,260 A 1/1916 Albrecht
1,231,816 A 7/1917 Vesterling
1,331,226 A 2/1920 Adams
1,398,034 A 11/1921 Mero
1,398,388 A 11/1921 Murphy
1,398,540 A 11/1921 Day
1,402,018 A 1/1922 Schade
1,473,354 A 11/1923 Nachtrieb
1,548,748 A 8/1925 Riley
1,610,985 A 12/1926 Vea
1,733,548 A 10/1929 Martin
1,733,894 A 10/1929 Martin
1,765,353 A 6/1930 Myers
1,787,957 A 1/1931 Schade
1,797,447 A 3/1931 Savidge
1,816,021 A 7/1931 Meyerson
1,822,669 A 9/1931 Schade
1,857,291 A 5/1932 Trussell
1,919,784 A 7/1933 Freiberg
1,932,874 A 10/1933 Adams et al.
1,991,362 A 2/1935 Krag
1,996,463 A 4/1935 Dawson et al.
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,077,677 A 4/1937 Dawson
2,088,431 A 7/1937 Newman
2,089,211 A 8/1937 Krag
2,096,944 A 10/1937 Unger et al.
2,103,307 A 12/1937 Unger
2,104,046 A 1/1938 Krag
2,119,639 A 6/1938 Lotter
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis et al.
2,251,878 A 8/1941 Hanna
2,252,422 A 8/1941 Unger
2,260,929 A 10/1941 Bloore
2,268,431 A 12/1941 Slonneger
2,288,189 A 6/1942 Guinane
2,304,716 A 12/1942 Supin
2,311,492 A 2/1943 Unger
2,311,620 A 2/1943 Murphy
2,322,595 A 6/1943 Schade
2,389,115 A 11/1945 Anderson
2,421,799 A 6/1947 Martin
2,460,718 A 2/1949 Stevens
2,528,866 A 11/1950 Dawson, Jr.
2,543,866 A 3/1951 Panfil
2,548,618 A 4/1951 Purvis
2,552,076 A 5/1951 Wedge
2,612,169 A 9/1952 Segal
2,645,227 A 7/1953 Segal
2,664,897 A 1/1954 Derringer
2,711,555 A 6/1955 Hanson
2,715,906 A 8/1955 Lucchesi
2,789,561 A 4/1957 Bonn
2,865,377 A 12/1958 Schroer et al.
2,871,711 A 2/1959 Stark
2,891,553 A 6/1959 Acton
2,894,513 A 7/1959 Gempe
3,077,888 A 2/1963 Thieme
3,098,489 A 7/1963 Vernon
3,098,490 A 7/1963 Wance
3,104,667 A 9/1963 Mintz
3,135,266 A 6/1964 Bouhier
3,149,636 A 9/1964 Rankin
3,190,293 A 6/1965 Schneider et al.
3,205,894 A 9/1965 Rankin
3,205,895 A 9/1965 Johnson
3,246,653 A 4/1966 Sexton
3,253,842 A 5/1966 Rabe
3,255,759 A 6/1966 Dennis
3,331,373 A 7/1967 Lohmeier
3,348,550 A 10/1967 Wolf et al.
3,718,402 A 2/1973 Schade
3,728,036 A 4/1973 Cott
3,748,051 A 7/1973 Frank
3,827,111 A 8/1974 O'Connell
3,833,308 A 9/1974 Seaborn
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,308,637 A 1/1982 Kucera
4,352,582 A 10/1982 Eliasson
4,415,290 A 11/1983 Ohminato
4,486,112 A 12/1984 Cummins
4,522,526 A 6/1985 Lozfau et al.
4,551,118 A 11/1985 Spisz
4,566,817 A 1/1986 Barrett, Jr.
4,571,108 A 2/1986 Vogl
4,607,970 A 8/1986 Heusinkveld
4,624,595 A 11/1986 Ohminato
4,678,357 A 7/1987 Kissel et al.
4,690,580 A 9/1987 Kissel
4,696,595 A 9/1987 Pinkney
4,798,491 A 1/1989 Lässle
4,813,803 A 3/1989 Gross
4,815,882 A 3/1989 Ohminato
4,886,390 A 12/1989 Silence
4,904,103 A 2/1990 Im
4,919,557 A 4/1990 Podosek
D317,177 S 5/1991 Wandemberg-Boschetti
5,018,896 A 5/1991 Vanni
5,116,157 A 5/1992 Gillum et al.
5,180,247 A 1/1993 Yu
5,201,101 A 4/1993 Rouser
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A * 2/1995 Mullin et al. ..... 402/41
5,476,335 A 12/1995 Whaley
5,524,997 A 6/1996 von Rohrscheidt
5,577,852 A 11/1996 To
5,651,628 A 7/1997 Bankes
5,660,490 A 8/1997 Warrington
5,692,847 A 12/1997 Zane et al.
5,692,848 A 12/1997 Wada
5,697,722 A 12/1997 Hladik et al.
5,718,529 A 2/1998 Chan
5,765,956 A 6/1998 Lanzarin

(56) References Cited

U.S. PATENT DOCUMENTS

| | | | | |
|---|---|---|---|---|
| 5,782,569 | A | 7/1998 | Mullin et al. | |
| 5,807,006 | A | 9/1998 | Cheung | |
| 5,810,499 | A | 9/1998 | Law | |
| 5,816,729 | A | 10/1998 | Whaley | |
| 5,827,004 | A | 10/1998 | Kim | |
| 5,836,709 | A | 11/1998 | Cheung | |
| 5,868,513 | A | 2/1999 | Law | |
| 5,879,097 | A | 3/1999 | Cheng | |
| 5,882,135 | A | 3/1999 | Ko | |
| 5,895,164 | A | 4/1999 | Wu | |
| 5,924,811 | A | 7/1999 | To | |
| 5,938,365 | A | 8/1999 | Grewe | |
| 5,957,611 | A | 9/1999 | Whaley | |
| 5,975,784 | A | 11/1999 | Whaley | |
| 5,975,785 | A | 11/1999 | Chan | |
| 6,036,394 | A | 3/2000 | Cheng | |
| D430,204 | S | 8/2000 | Berracasa | |
| 6,109,813 | A | 8/2000 | To et al. | |
| 6,146,042 | A | 11/2000 | To | |
| 6,155,737 | A * | 12/2000 | Whaley | 402/5 |
| 6,179,508 | B1 | 1/2001 | Coerver | |
| 6,203,229 | B1 | 3/2001 | Coerver | |
| 6,206,601 | B1 | 3/2001 | Ko | |
| 6,217,247 | B1 | 4/2001 | Ng | |
| 6,270,279 | B1 | 8/2001 | Whaley | |
| 6,270,280 | B1 | 8/2001 | Baumann | |
| 6,276,862 | B1 * | 8/2001 | Snyder et al. | 402/40 |
| 6,293,722 | B1 | 9/2001 | Holbrook et al. | |
| 6,328,497 | B1 | 12/2001 | To | |
| 6,364,558 | B1 | 4/2002 | To | |
| 6,371,678 | B1 | 4/2002 | Chizmar | |
| 6,467,984 | B1 | 10/2002 | To | |
| 6,474,897 | B1 | 11/2002 | To | |
| 6,533,486 | B1 | 3/2003 | To | |
| 6,749,357 | B2 | 6/2004 | Cheng | |
| 6,758,621 | B2 | 7/2004 | To | |
| 6,761,497 | B2 | 7/2004 | Kaneda | |
| 6,821,045 | B2 | 11/2004 | Whaley | |
| 6,840,695 | B2 | 1/2005 | Horn | |
| 6,916,134 | B2 | 7/2005 | Wong | |
| D533,588 | S | 12/2006 | Cheng | |
| 7,275,886 | B2 | 10/2007 | Cheng | |
| 7,293,932 | B2 | 11/2007 | Wong | |
| 7,296,946 | B2 | 11/2007 | Cheng | |
| 7,360,962 | B2 | 4/2008 | To | |
| 2003/0044221 | A1 | 3/2003 | To | |
| 2003/0103798 | A1 | 6/2003 | Cheng et al. | |
| 2003/0123923 | A1 | 7/2003 | Koike et al. | |
| 2004/0013463 | A1 | 1/2004 | To | |
| 2004/0086323 | A1 | 5/2004 | Tanaka | |
| 2005/0013654 | A1 | 1/2005 | Cheng et al. | |
| 2005/0201817 | A1 | 9/2005 | Cheng | |
| 2005/0201818 | A1 | 9/2005 | Cheng | |
| 2005/0201820 | A1 | 9/2005 | Ng | |
| 2005/0214064 | A1 | 9/2005 | Ng | |
| 2005/0232689 | A1 | 10/2005 | Cheng | |
| 2005/0271459 | A1 | 12/2005 | To | |
| 2006/0008318 | A1 | 1/2006 | Ng | |
| 2006/0056906 | A1 | 3/2006 | Horn | |
| 2006/0088365 | A1 | 4/2006 | Whaley | |
| 2006/0147253 | A1 | 7/2006 | Cheng | |
| 2006/0147254 | A1 | 7/2006 | Cheng | |
| 2006/0147255 | A1 | 7/2006 | Cheng | |
| 2006/0153628 | A1 | 7/2006 | Tanaka | |
| 2006/0153629 | A1 | 7/2006 | Cheng | |
| 2006/0216107 | A1 | 9/2006 | Lin | |
| 2006/0228164 | A1 | 10/2006 | Horn | |
| 2006/0251467 | A1 | 11/2006 | Cheng | |
| 2006/0251468 | A1 | 11/2006 | Cheng | |
| 2007/0086836 | A1 | 4/2007 | Cheng | |
| 2008/0075526 | A1 | 3/2008 | Ng | |
| 2008/0075527 | A1 | 3/2008 | Pi | |
| 2008/0089736 | A1 | 4/2008 | Cheng | |

FOREIGN PATENT DOCUMENTS

| | | | |
|---|---|---|---|
| FR | 1 346 864 | A | 12/1963 |
| FR | 2221924 | | 10/1974 |
| FR | 2 238 332 | A | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 59-79379 | | 5/1984 |
| JP | 61-18880 | | 2/1986 |
| JP | 1299095 | A | 12/1989 |
| JP | 2034289 | U | 3/1990 |
| JP | 4-120085 | | 10/1992 |
| JP | 2004098417 | | 4/2004 |
| WO | 2005035265 | | 4/2005 |

OTHER PUBLICATIONS

Office Action dated Dec. 15, 2005 from related U.S. Appl. No. 10/613,479, 12 pgs.

Office Action dated Jan. 12, 2006 from related U.S. Appl. No. 10/613,479, 16 pgs.

Office Action dated Jul. 20, 2006 from related U.S. Appl. No. 10/613,479, 13 pgs.

Office Action dated Jan. 30, 2007 from related U.S. Appl. No. 10/613,479, 13 pgs.

Office Action dated Aug. 9, 2007 from related U.S. Appl. No. 10/613,479, 10 pgs.

Kokuyo Lock Ring Mechanism with description, two instructions sheets, and nine photographs, undated but admitted as prior art, 12 pgs.

Office Action dated Jan. 3, 2008 from related U.S. Appl. No. 10/870,165, 14 pgs.

Office Action dated Aug. 7, 2008 from related U.S. Appl. No. 10/905,031, 11 pgs.

* cited by examiner

SOFT CLOSE RING BINDER MECHANISM WITH MATING RING TIPS

CROSS-REFERENCE TO RELATED APPLICATIONS

This application claims the benefit of U.S. patent application Ser. No. 10/870,165, filed Jun. 17, 2004, and entitled Soft Close Ring Binder Mechanism, which claims the benefit of U.S. Prov. Pat. Appl. No. 60/553,155, filed Mar. 15, 2004, and entitled Soft Close Ring Binder Mechanism. This application also claims the benefit of U.S. patent application Ser. No. 10/967,882, filed Oct. 18, 2004, and entitled Interlocking Ring Tip Formations For Paired Ring Members Of a Ring Binder Mechanism. The entire disclosures of all of these patent applications are hereby incorporated by reference.

BACKGROUND OF THE INVENTION

This invention relates to a ring binder mechanism for retaining loose-leaf pages, and in particular to an improved mechanism for reducing snapping motion of ring members as they close, for securely locking closed ring members together, and for preventing misalignment of closed ring members.

A ring binder mechanism retains loose-leaf pages, such as hole-punched pages, in a file or notebook. It has rings for retaining the pages. The rings may be selectively opened to add or remove pages to the rings or closed to retain pages on the rings while allowing the pages to move along the rings. Ring members of each ring mount on two adjacent hinge plates. The hinge plates join together about a pivot axis for pivoting movement within an elongate housing. The housing holds the hinge plates so they may pivot relative to the housing and move the ring members between an open position and a closed position.

The undeformed housing is narrower than the joined hinge plates when the hinge plates are in a coplanar position (180 degrees). So as the hinge plates pivot through this position, they deform the resilient housing and cause a spring force in the housing that urges the hinge plates to pivot away from the coplanar position and move the ring members to either their open or closed position. This spring force is generally large so that the housing can resist unwanted hinge plate movement through the co-planar position (e.g., hold the hinge plates against movement tending to open closed ring members).

However, the large housing spring force causes the hinge plates to pass through the co-planar position with a strong snapping movement. As a result, closing ring members may snap together rapidly and with a force that might cause fingers to be pinched between the ring members. The large spring force can also make it difficult to move the hinge plates through the co-planar position so that it is difficult to open and close the ring members. In addition, the housing may begin to permanently deform over time because of repeated movement of the hinge plates through their co-planar position. This may reduce the housing's ability to resist unwanted hinge plate movement.

Some ring mechanisms include locking structure that positively blocks the pivoting movement of the hinge plates when the ring members are closed. This allows the housing spring force to be reduced while still securely locking the closed ring members together. But the paired ring members of these ring mechanisms often have free ends with tip formations that do not always exactly align when the ring members are closed. Misalignment of the ring members in directions transverse to longitudinal centerlines of the ring members is common.

Moreover, even if alignment is initially perfect upon closure, the free ends may still be able to move relative to each other after the ring members close. While the engagement of the ring member free ends may be capable of resisting displacement in one direction, most cannot resist displacement in a second, perpendicular direction. For example, the ring member free ends are often shaped to resist relative displacement toward and away from the longitudinal axis of the ring binder mechanism, but provide no resistance to relative movement in directions along the length of the ring binder mechanism. Accordingly, pages bound by these known mechanisms may not smoothly move from one ring member to the other and may be torn.

Accordingly, there is a need for a ring binder mechanism that positively locks to hold closed ring members together and that has paired ring members with free end formations that prevent misalignment of the closed ring members in all directions transverse to longitudinal centerlines of the ring members.

SUMMARY OF THE INVENTION

This invention provides a ring binder mechanism for retaining loose-leaf pages. The mechanism comprises a housing, hinge plates supported by the housing for pivoting motion about a pivot axis relative to the housing, and rings for holding the loose-leaf pages. Each ring includes first and second ring members with a longitudinal centerline. The first ring member is mounted on a first hinge plate and is moveable with the pivoting motion of the first hinge plate relative to the second ring member. In a closed position, a free end of the first ring member joins with a free end of the second ring member. In an open position, the free end of the first ring member separates from the free end of the second ring member. The free end of the first ring member has an interlocking configuration with a first shape, and the free end of the second ring member has an interlocking configuration with a second shape adapted to interengage with the interlocking configuration of the second ring member. The interengagement of the configurations resists misalignment of the first and second ring members in all directions transverse to the longitudinal centerlines of the ring members when the ring members are in their closed position. The mechanism also comprises a control structure supported by the housing and movable relative to the housing. The control structure resists separation of the free ends of the ring members when the ring members are in their closed position.

Other features of the invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

Figure 1:
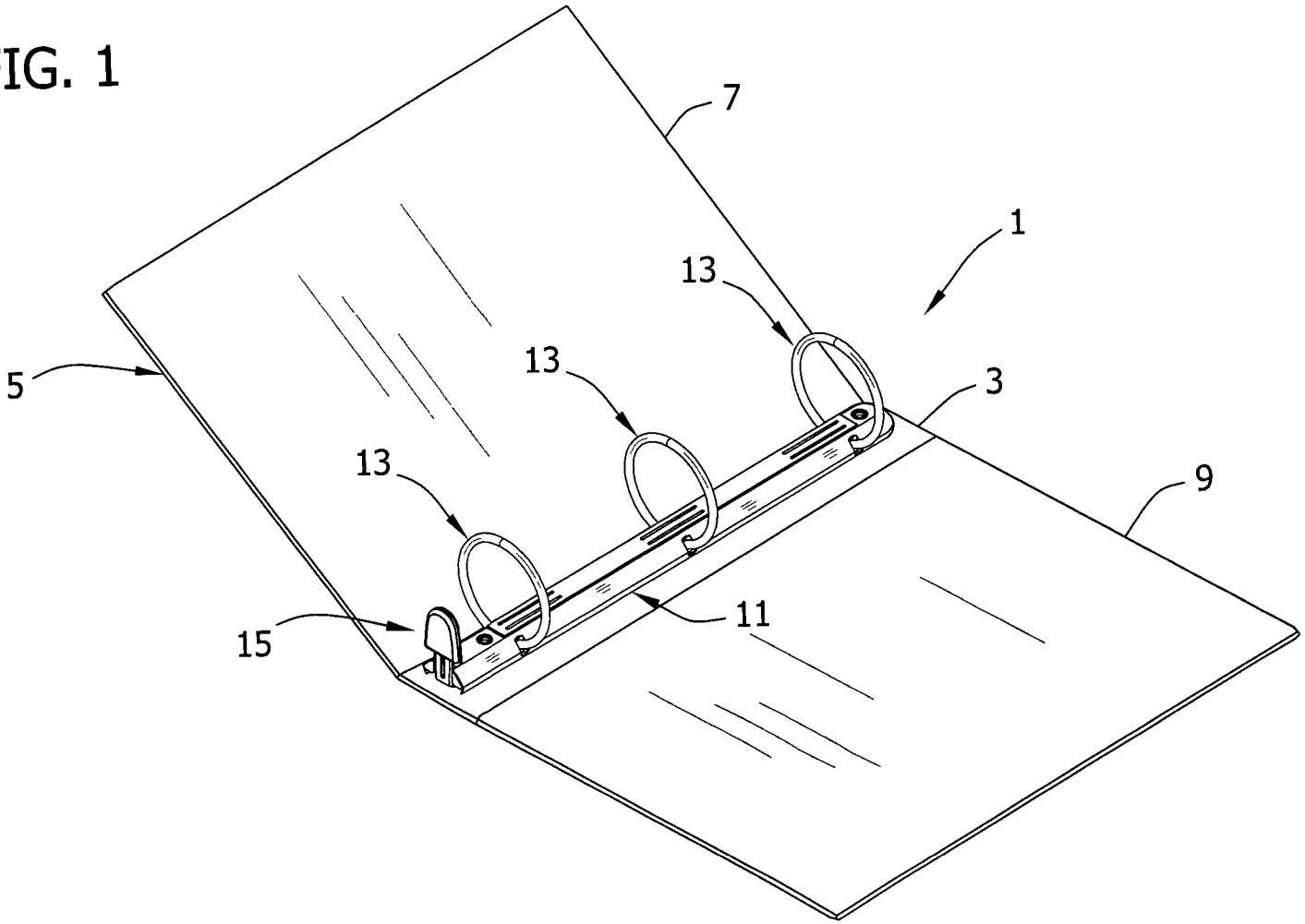
FIG. 1 is a perspective of a notebook incorporating a ring binder mechanism of the invention according to a first embodiment.

Referring now to the drawings of the present invention, FIG. 1 shows a first embodiment of a ring binder mechanism of the present invention capable of retaining loose-leaf pages (not shown). The mechanism is generally designated by reference numeral 1 and is shown mounted on a spine 3 of a notebook 5 having a front cover 7 and a back cover 9 hingedly attached to the spine 3. The front and back covers 7, 9 move to selectively cover or expose retained pages. Ring binder mechanisms mounted on surfaces other than a notebook, however, do not depart from the scope of this invention. The mechanism 1 of this embodiment generally includes a housing 11, three rings (each generally indicated at 13), and a control structure (generally indicated at 15). As shown in FIGS. 2A-3B, the housing 11 supports both the rings 13 and the control structure 15 for either closing the mechanism 1 to retain pages on the rings 13 or opening it to load pages on the rings 13. As will be described hereinafter, the control structure 15 can directly close and lock the mechanism 1 and can allow wire form springs 17 attached to undersides of hinge plates 19, 21 to open the mechanism 1.

Figure 4:
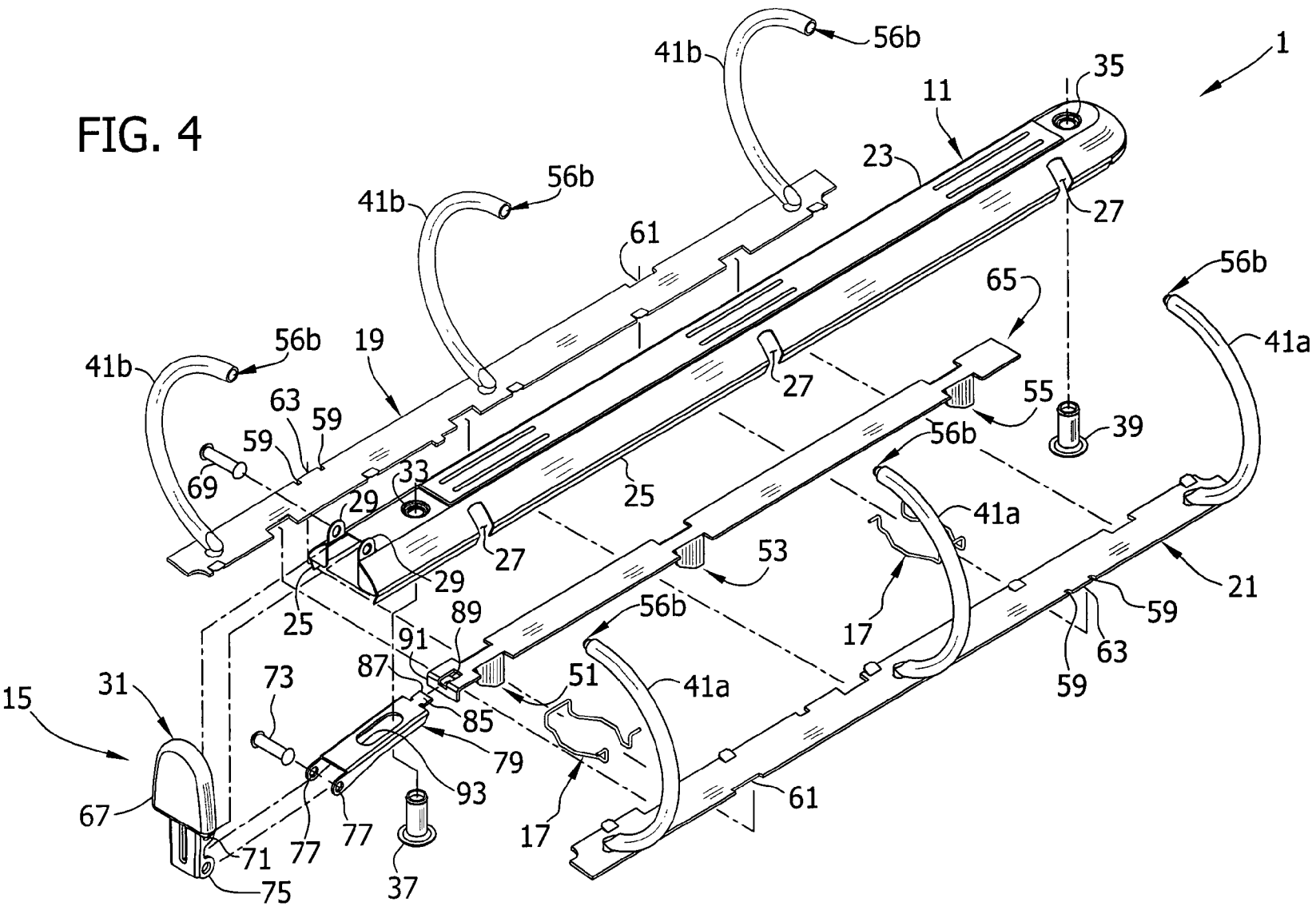
FIG. 4 is an exploded perspective of the mechanism.

Referring to FIG. 4, the housing 11 is elongate and has a symmetrical, roughly arch-shaped cross section with a raised plateau 23 at its center. The housing 11 is made of metal, but may be also made of other suitable material that is sufficiently rigid to provide a stable mount for other components of the mechanism 1 while being sufficiently resilient to function as a spring. The housing 11 has a longitudinal axis, two transversely opposite longitudinally extending edges, and two longitudinal ends. A bent under rim 25 is formed along each longitudinal edge margin of the housing and together the two bent under rims 25 include six slots 27 (only three of which are visible) arranged in three transversely opposed pairs along the length of the housing 11 for receiving the rings 13 (see FIGS. 2A and 3A). At one housing end, two tabs 29 project upward for attaching a lever (broadly, an "actuator"), generally indicated by reference numeral 31, of the control structure. The opposite housing end does not have a lever, although it is understood that a mechanism with two levers or a mechanism with the lever attached between its ends does not depart from the scope of this invention. The raised plateau 23 of the housing has two openings 33, 35 for receiving and attaching mounting posts 37, 39 capable of securing the mechanism 1 to the notebook 5. Different shaped housings, including asymmetrical ones, and housings with different numbers of openings or slots do not depart from the scope of this invention.

The housing 11 loosely supports two hinge plates 19, 21 for pivoting motion to either close the rings 13 or open the rings. Each ring 13 includes two ring members 41*a*, 41*b* mounted on adjacent hinge plates 19, 21 and movable therewith between a closed position (see FIGS. 2A and 2B) and an open position (see FIGS. 3A and 3B). These ring members 41*a*, 41*b* are generally circular in cross section and are formed of suitable material such as steel. When they are in the closed position, each ring member 41*a*, 41*b* forms a substantially continuous, closed, circular ring or loop for retaining loose-leaf pages and for allowing the pages to move along the rings 13 from one ring member 41*a*, 41*b* to the other. And when the ring members 41*a*, 41*b* are in the open position, each forms a discontinuous, open loop suitable for adding or removing pages. Although in the illustrated embodiment both ring members 41*a*, 41*b* can move, a mechanism having one movable ring member and one fixed does not depart from the scope of this invention. Additionally, a mechanism with more or less than three rings or with rings that form other shapes, such as a "D" shape, when closed does not depart from the scope of this invention.

Figure 2A:
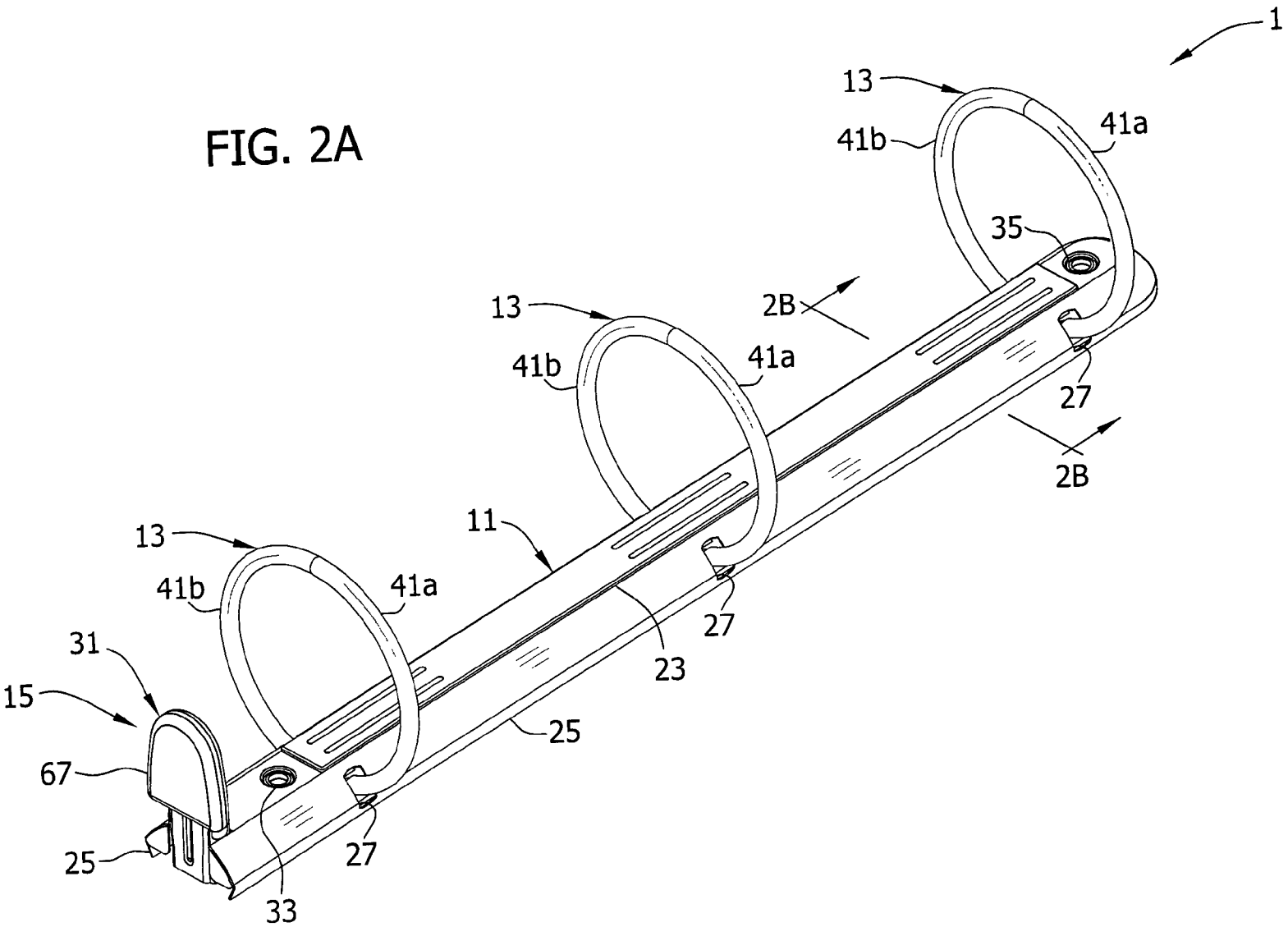
FIG. 2A is a perspective of the mechanism at a closed and locked position.
Figure 2B:
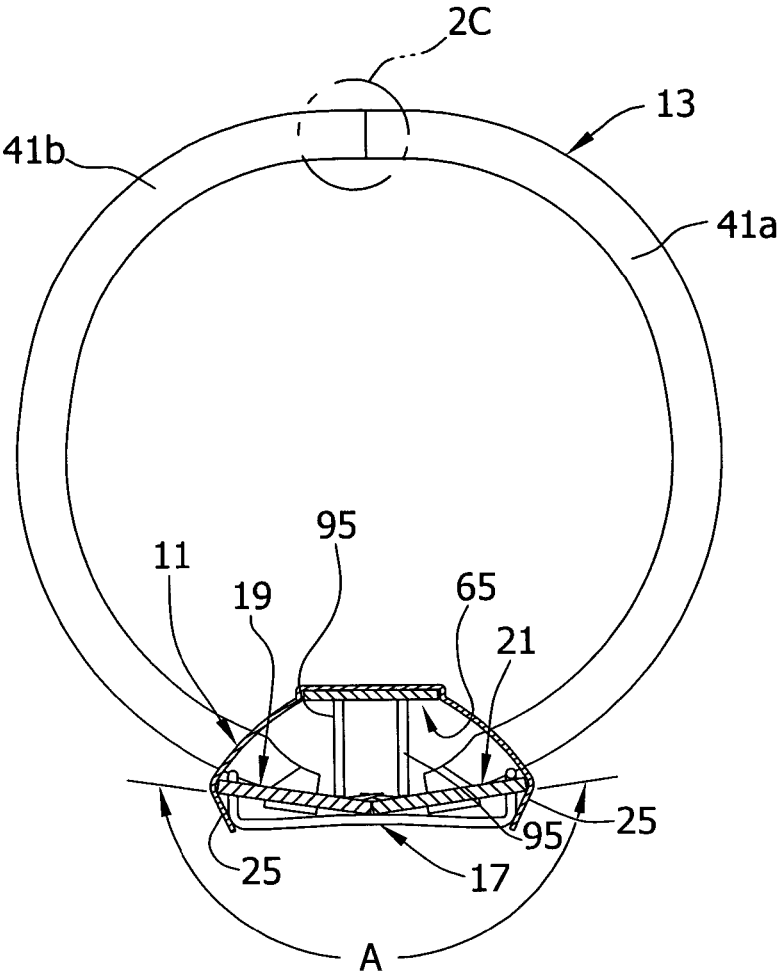
FIG. 2B is a section taken in the plane of line 2B-2B of FIG. 2A.
Figure 2C:
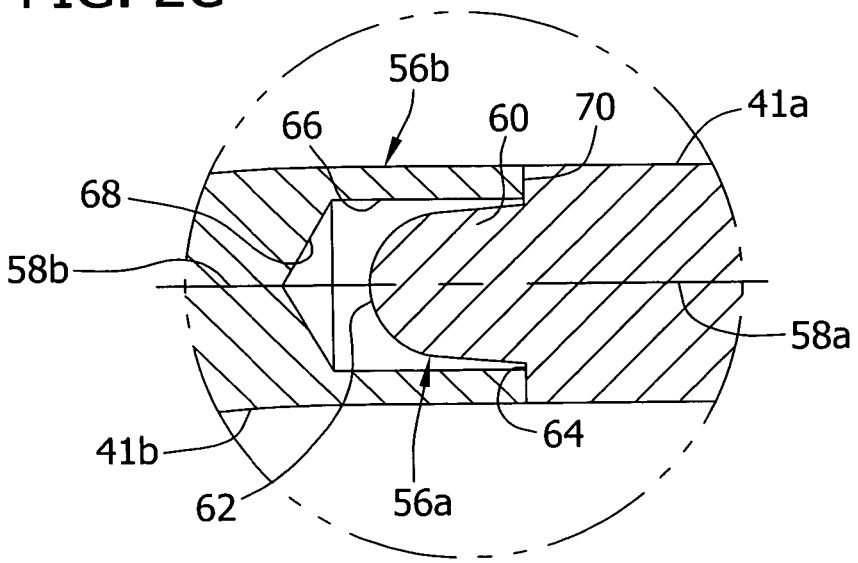
FIG. 2C is an enlarged sectional detail taken from FIG. 2B and showing interlocking ring tip configurations of ring members of the mechanism.
Figure 3A:
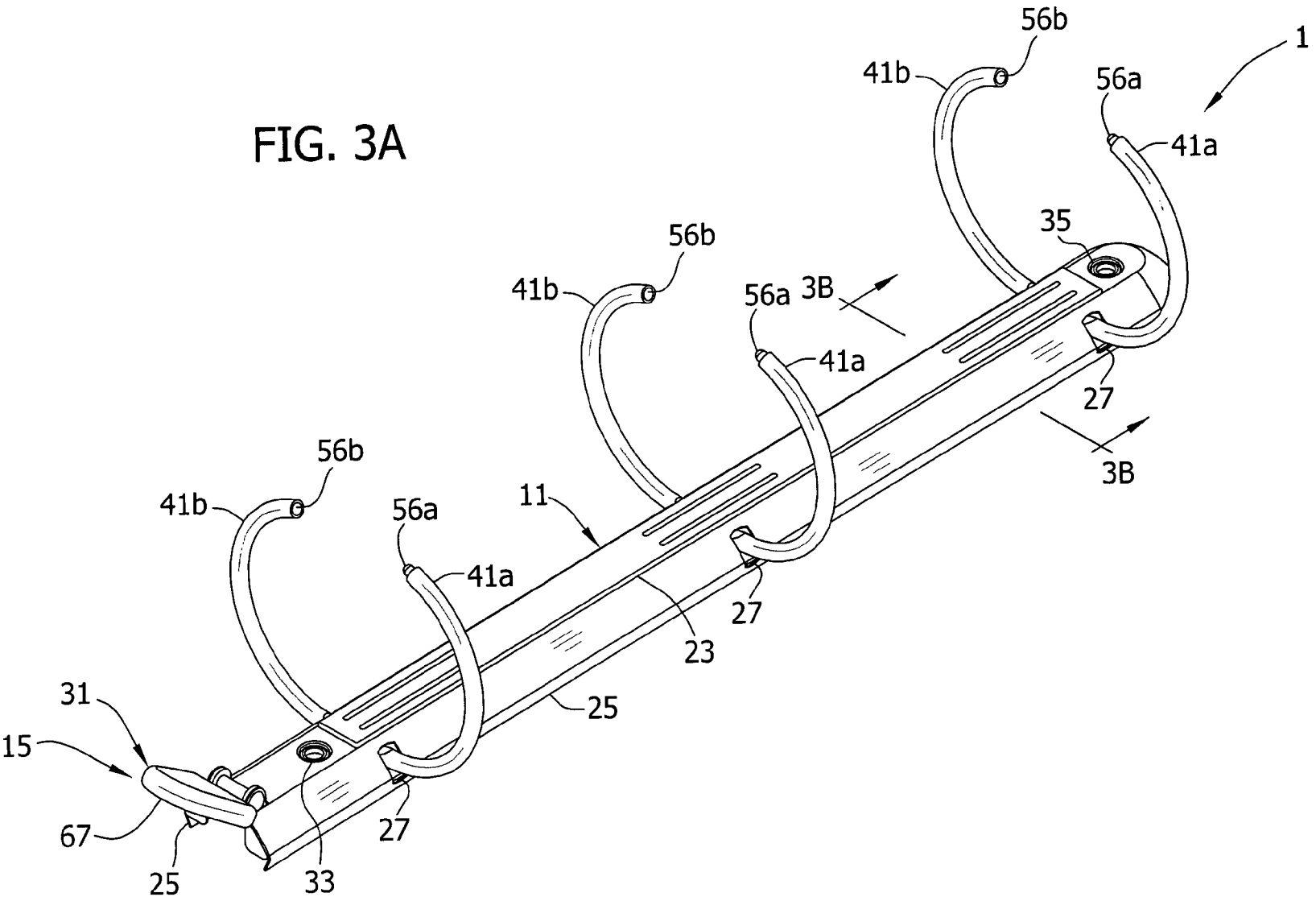
FIG. 3A is a perspective similar to FIG. 2A with the mechanism at an open position.
Figure 3B:
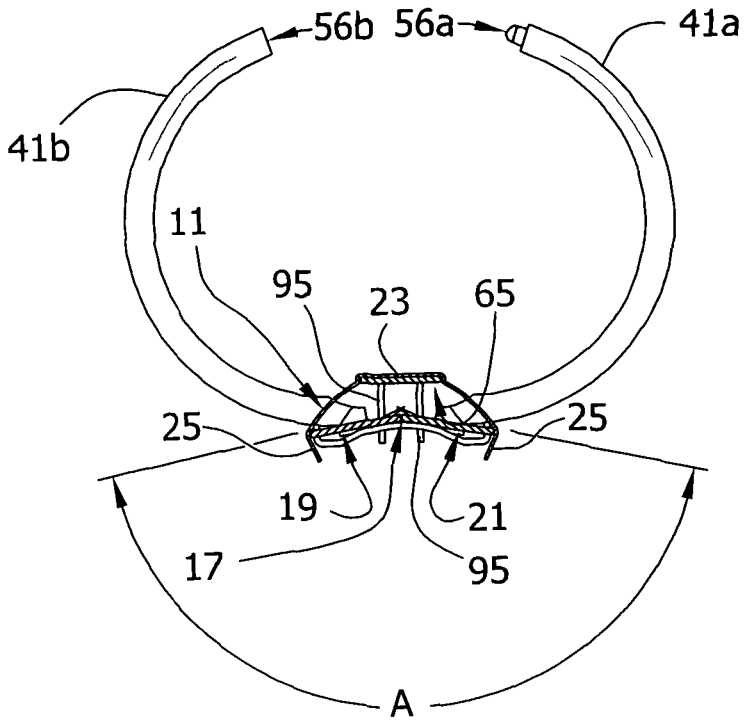
FIG. 3B is a section taken in the plane of line 3B-3B of FIG. 3A.

As shown in FIGS. 2B and 2C, free ends (longitudinal ends of the ring members 41*a*, 41*b* opposite the ends mounted on the hinge plates 19, 21) of the ring members 41*a*, 41*b* of each ring 13 are formed with interlocking configurations 56*a*, 56*b* that are interengagable when the ring members close. The configurations 56*a*, 56*b* prevent the closed ring members 41*a*, 41*b* from misaligning in a direction transverse to longitudinal centerlines 58*a*, 58*b*, respectively, of the ring members. Interlocking configuration 56*a* of ring member 41*a* includes a centrally convex finger 60 located along centerline 58*a* and projecting outward from the free end of the ring member. The finger 60 has a circular cross section (taken transverse to centerline 58*a*) similar to the circular section of the ring member 41*a* and tapers inward toward its tip 62 where it is generally rounded in shape. A shoulder 64 is formed circumferentially around the finger 60 where it extends out from the free end of the ring member 41*a*.

Interlocking configuration 56*b* of ring member 41*b* includes a centrally concave bore 66 located along centerline 58*b* and recessed inward from the free end of the ring member. The bore 66 is cylindrical in shape and has a conical bottom 68 at its end within the ring member 41*b*. A shoulder 70 between the bore 66 and the outer surface of the ring member 41*b* is disposed for engaging the shoulder 64 of the ring member 41*a* when the ring members are closed.

The diameter of the cylindrical bore 66 is slightly larger than the widest diameter of the tapering finger 60, and a depth of the bore 66 is greater than a height of the finger 60. The finger 60 fits completely within the bore 66 when the ring members 41*a*, 41*b* close with the shoulder 64 of interlocking configuration 56*a* fitting closely against the shoulder 70 of interlocking configuration 56*b*. In this position, an outer surface of ring member 41*a* aligns with an outer surface of ring member 41*b* and pages can move over the ring members without catching or tearing on the interlocking configurations 56*a*, 56*b*. This close fit holds the ring members 41*a*, 41*b* against movement transverse to their centerlines 58*a*, 58*b* after they are closed (e.g., transverse separation of the free ends of the ring members). For example, if the ring mechanism 1 is accidentally dropped, the interlocking configurations 56*a*, 56*b* will remain interengaged and will hold the closed ring members 41*a*, 41*b* against transverse separation. The ring members 41*a*, 41*b* will thus remain in their continuous loop retaining loose-leaf pages.

In addition, the interlocking configurations 56*a*, 56*b* resist misalignment of the ring members 41*a*, 41*b* when they move toward their closed position. In particular, they are shaped such that the rounded finger tip 62 of configuration 56*a* of ring member 41*a* engages the shoulder 70 around bore 66 of configuration 56*b* of ring member 41*b* and cams the two ring members into alignment. It can thus be seen that the closing ring members 41*a*, 41*b* incorporating the interlocking configurations 56*a*, 56*b* of this invention can align themselves as they close.

Figure 5:
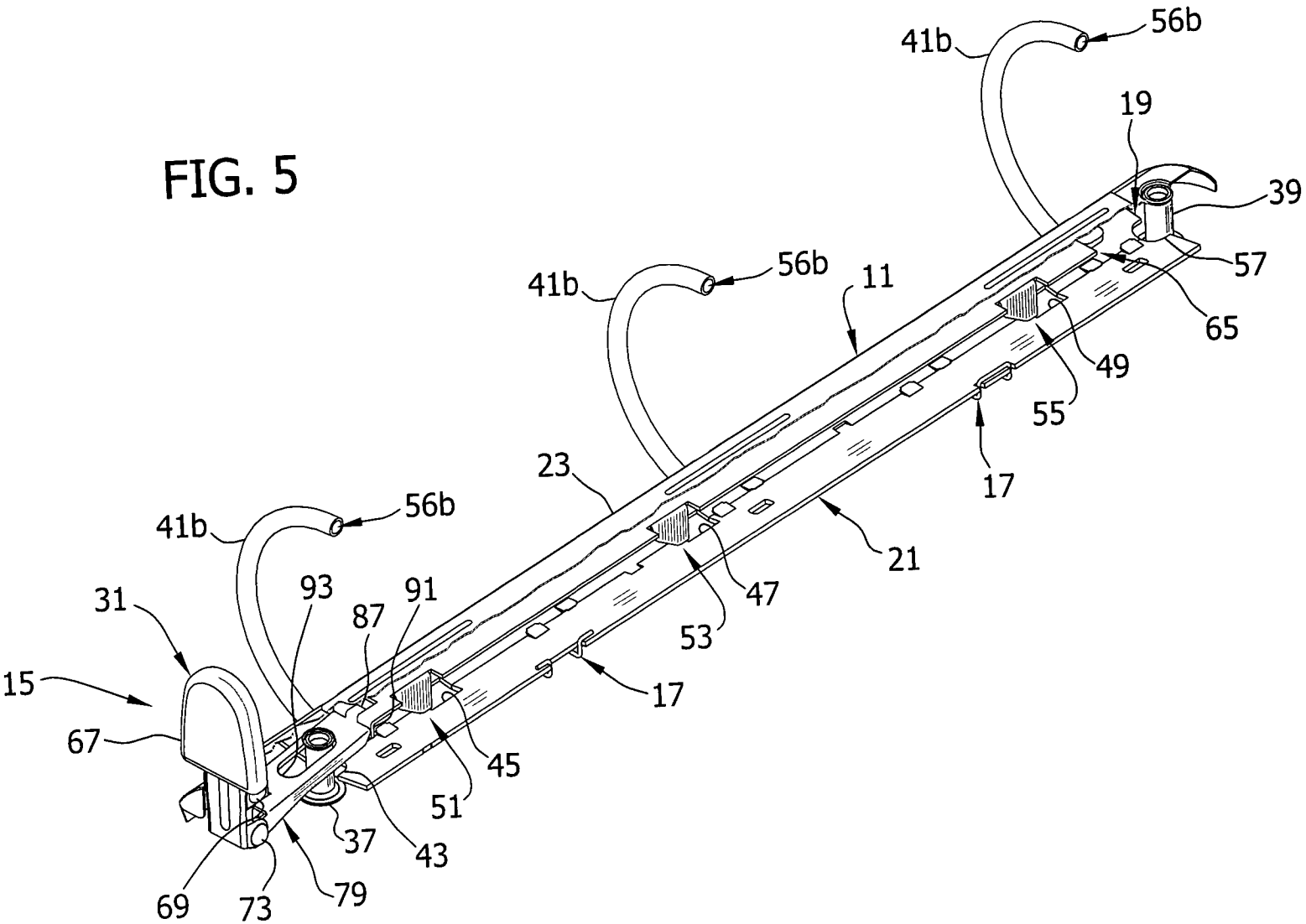
FIG. 5 is a perspective similar to FIG. 2A with a housing thereof broken away and ring members removed.

Referring now to FIGS. 4 and 5, the hinge plates 19, 21 are generally each a thin, elongate sheet having inner and outer longitudinal edge margins and two longitudinal ends. Each hinge plate 19, 21 includes five cutouts along its inner longitudinal edge margin so that when the hinge plates 19, 21 are interconnected, corresponding cutouts in each plate align to form five openings. A first opening 43, located near the housing end having the lever 31, receives a first of the mounting posts 37 through the hinge plates 19, 21. Second, third, and fourth openings 45, 47, 49 receive first, second, and third locking elements 51, 53, 55 respectively, as will be discussed hereinafter. A fifth opening 57, located near the housing end not having the lever 31, receives a second of the mounting posts 39 through the hinge plates 19, 21. Each hinge plate 19, 21 also includes two notches 59 and one cutout 61, both located along the plate's outer longitudinal edge margin. The notches 59 are arranged relatively side-by-side and define a tab 63 located toward one longitudinal end of each hinge plate 19, 21. The cutout 61 is located toward an opposite longitudinal end. The tab 63 and cutout 61 are positioned in reverse order on the two hinge plates 19, 21 so that when the plates 19, 21 interconnect one plate's tab 63 is across from a second plate's cutout 61. This facilitates attaching the wire form springs 17 to the underside of the interconnected hinge plates 19, 21, as will be described more fully hereinafter.

The interconnected hinge plates 19, 21 attach to one another in parallel arrangement along their adjoining inner longitudinal edge margins, forming a central hinge having a pivot axis. The housing 11 receives the interconnected plates 19, 21 such that each plates's outer longitudinal edge margin loosely fits in the housing's corresponding bent under rim 25 (see FIGS. 2B and 3B). Accordingly, the hinge plates 19, 21 are retained on the housing 11 but the edge margins are free to move within the rims 25, allowing the hinge plates 19, 21 to freely pivot about their pivot axis. The pivot axis moves up (i.e., toward the housing's raised plateau 23) when the plates 19, 21 pivot to open the ring members 41*a*, 41*b*, and it moves down (i.e., away from the housing's raised plateau 23) when the plates 19, 21 pivot to close the ring members.

The control structure 15 of this embodiment generally includes the lever 31, an intermediate connector 79, a travel bar 65, and the three locking elements 51, 53, 55 of the travel bar. The lever 31 is formed from a suitable rigid material or combination of materials, such as metal or plastic. It includes an enlarged head 67 to facilitate gripping and applying force to the lever 31. A first hinge pin 69 received through upper openings 71 in the lever and through the housing's tabs 29, mounts the lever 31 on the housing 11 for pivoting relative to the housing 11. A second hinge pin 73 is received through lower openings 75 in the lever 31 and through openings 77 in the intermediate connector 79, transforming the lever's pivoting motion into substantially linear travel bar motion. Although the travel bar's motion is not perfectly linear, it is still considered to be translational motion for purposes of the present invention.

The intermediate connector 79 is generally an elongate beam with a flat web and two side flanges. It includes a first end that is generally wider than a second end. More specifically, at the narrower second end the intermediate connector 79 includes a projecting tab 85 with an enlarged end 87 that is received in a slot 89 in a first end of the travel bar 65. This end of the travel bar is bent down to form a shoulder 91 against one side of which the intermediate connector 79 can bear to push the travel bar 65. The enlarged end 87 of the projecting tab 85 is engageable with the other side of the shoulder 91 to pull the travel bar 65 toward the lever 31. The slot 89 in which the tab 85 is received is elongate in the lengthwise direction of the travel bar 65. Thus, the intermediate connector 79 is able to freely pivot up and down with respect to the travel bar 65. As a result, the connector 79 transmits a linear movement to the travel bar 65 from the pivoting lever 31. Moreover, the travel bar 65 is allowed to move up and down without hindrance from the intermediate connector 79. The intermediate connector 79 also includes an elongate opening 93 for receiving the first mounting post 37 through the connector and allowing the connector to move relative to the mounting post 37.

Figure 6:
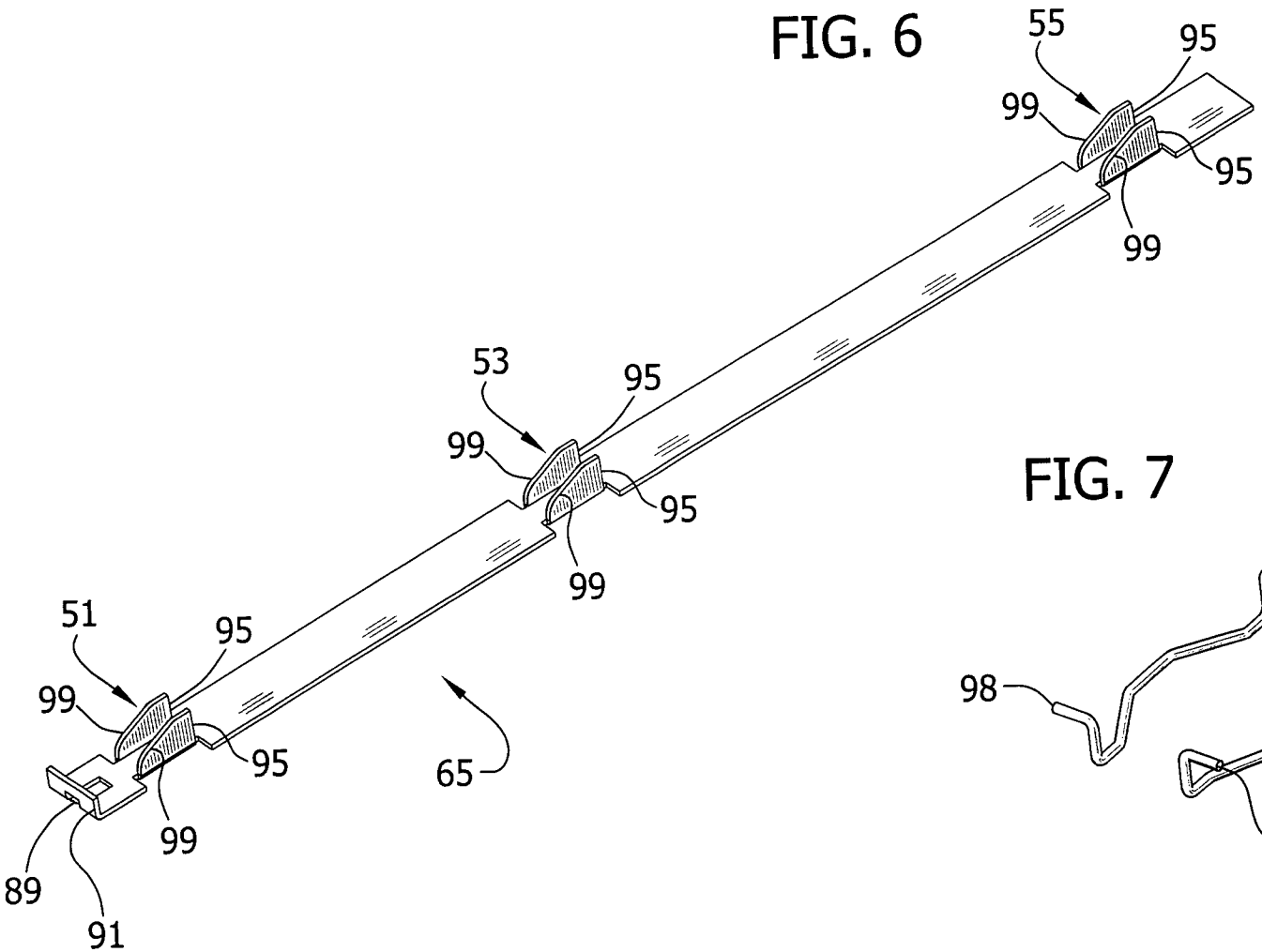
FIG. 6 is a bottom perspective of a travel bar of the first embodiment.

Now referring to FIGS. 4-6, the travel bar 65 receives the lever's pivoting motion and moves in translation generally lengthwise relative to both the housing 11 and the hinge plates 19, 21. The travel bar 65 is a relatively flat, elongate sheet made of metal or other sufficiently rigid material. It is disposed generally parallel to the longitudinal axis of the housing 11, under the housing's raised plateau 23 and above the hinge plates 19, 21. The travel bar 65 includes three integral locking elements 51, 53, 55 that move with the travel bar 65 in translation and, depending on the travel bar's position, can either (1) pivot the hinge plates 19, 21 for closing the ring members 41*a*, 41*b* and then block the hinge plates' pivoting motion for locking the ring members 41*a*, 41*b* closed or (2) allow the wire form springs 17 to pivot the hinge plates 19, 21 for opening the ring members 41*a*, 41*b* (i.e., the locking elements 51, 53, 55 can register with openings 45, 47, 49 in the hinge plates 19, 21, thereby allowing the wire form springs 17 to freely act against the hinge plates 19, 21 and pivot them, as will be discussed hereinafter).

As particularly shown in FIG. 6, in this embodiment the locking elements 51, 53, 55 each comprise two spaced apart locking flanges 95 formed as one piece with the travel bar 65 and folded downward 90 degrees from a longitudinal edge margin of the bar. Accordingly, there are three flanges 95 on each side of the travel bar 65, and each flange's planar surface is substantially parallel to that of every other flange 95 and to a longitudinal axis of the travel bar 65. A lower edge portion of each flange 95 is angled, forming a cam surface 99 for engaging the hinge plates 19, 21 and for causing them to pivot to close the ring members 41*a*, 41*b*. The angle is such that once the ring members 41*a*, 41*b* close, the locking elements 51, 53, 55 slide into position for locking the ring members 41*a*, 41*b* together. In addition, the locking elements 51, 53, 55 are spaced along the length of the travel bar 65 to correspond with the second, third, and fourth openings 45, 47, 49 in the hinge plates 19, 21 when the ring members 41*a*, 41*b* are open. It will be understood that locking elements may be formed as a single piece with a travel bar, or as more than two pieces, and that control structures using more or fewer than three locking elements, or differently shaped locking elements do not depart from the scope of this invention.

Figure 7:
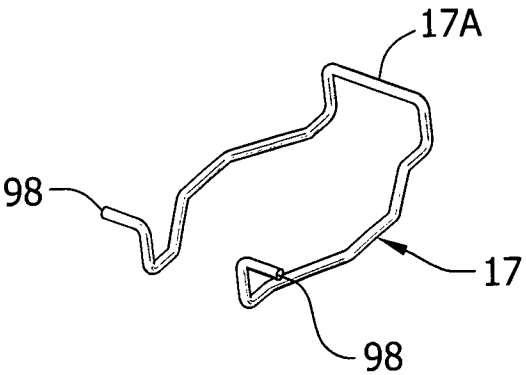
FIG. 7 is a perspective of a wire form spring of the first embodiment.
Figure 8:
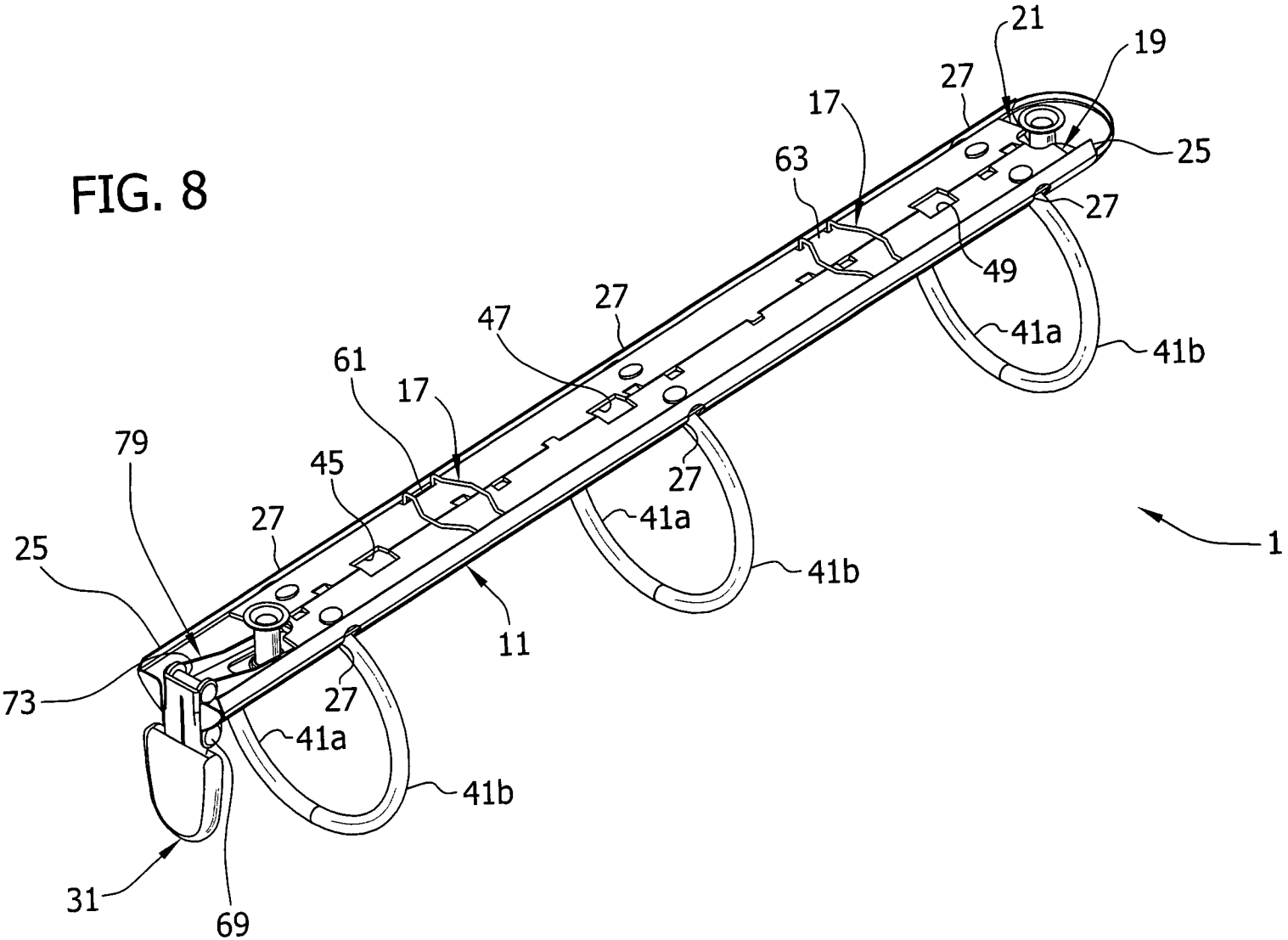
FIG. 8 is a bottom perspective of the ring binder mechanism at the closed and locked position.
Figure 9:
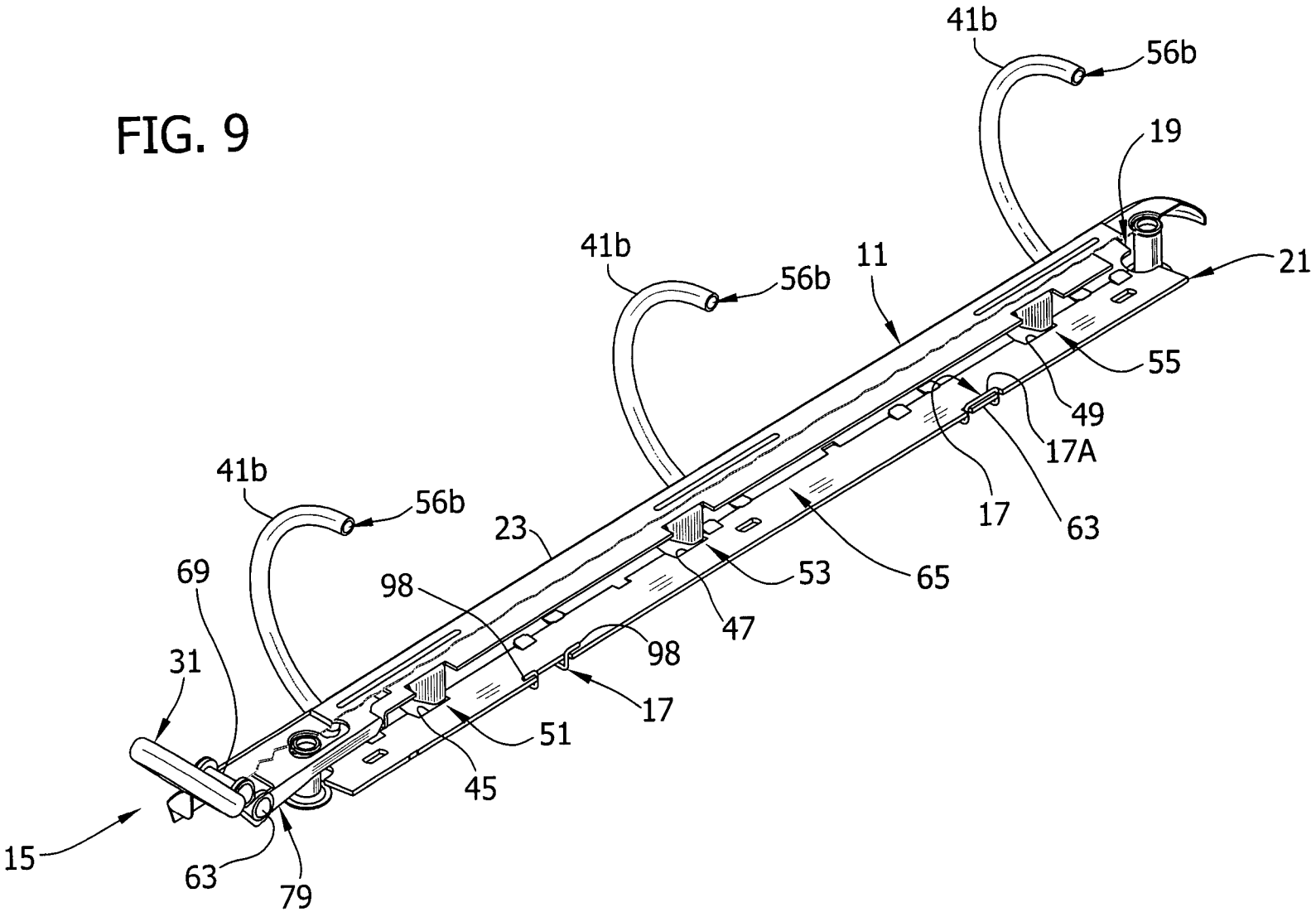
FIG. 9 is a perspective similar to FIG. 5 with the mechanism at an intermediate, transitional position between the open position and the closed and locked position.
Figure 10:
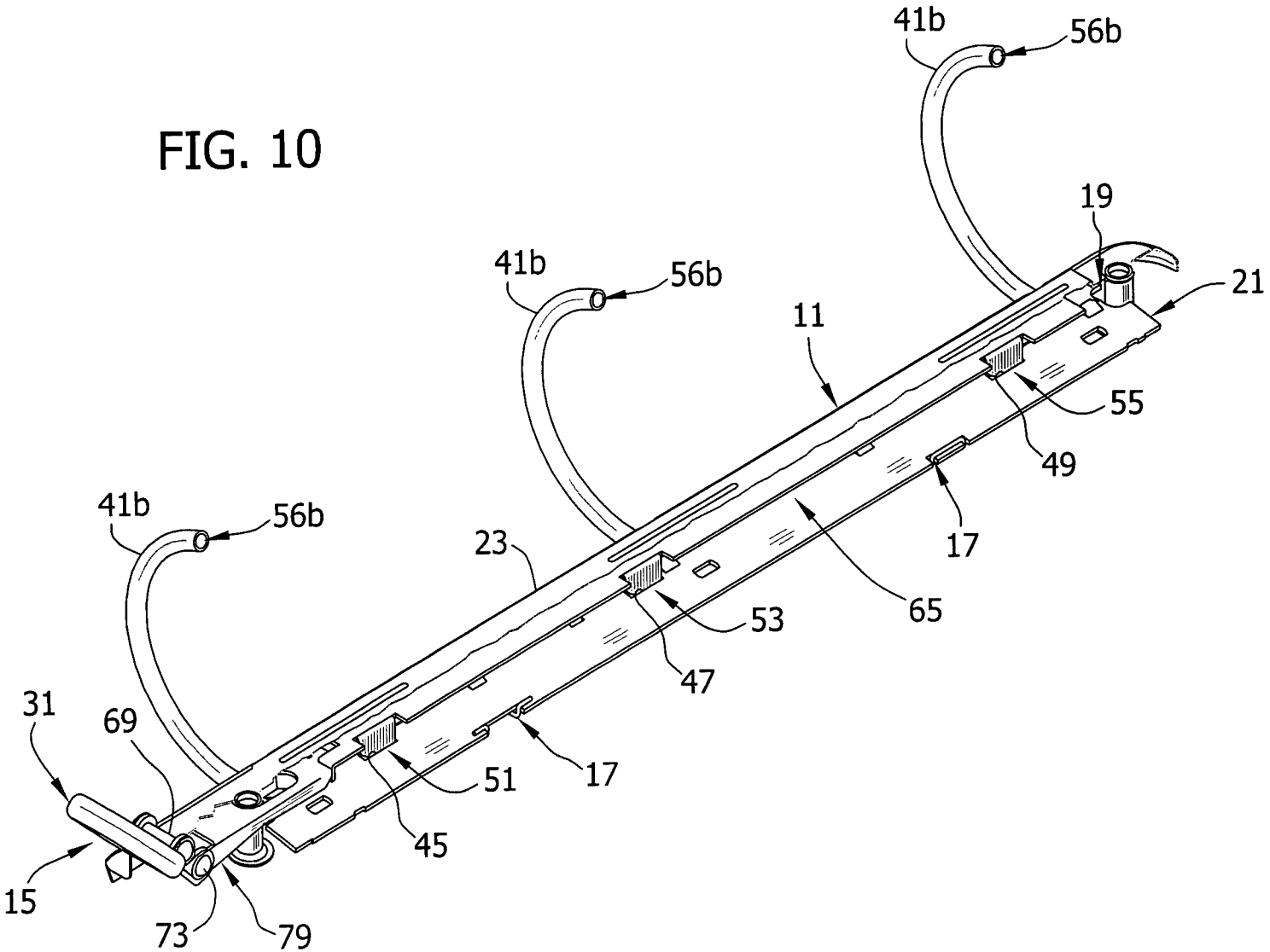
FIG. 10 is a perspective similar to FIG. 5 with the mechanism at the open position.
Figure 11:
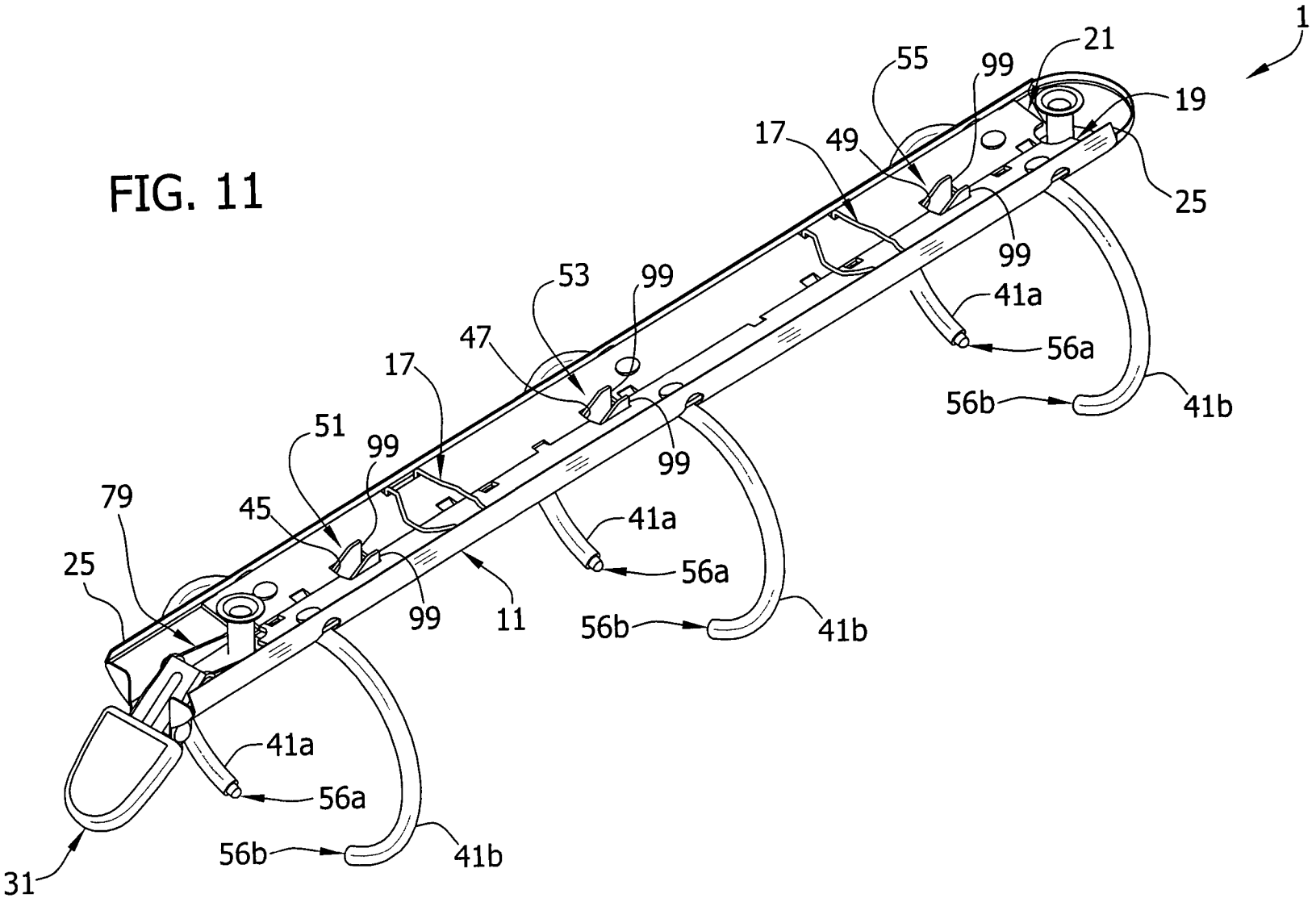
FIG. 11 is a perspective similar to FIG. 8 with the mechanism at the open position.

As shown in FIGS. 7-9, a wire form spring 17 of this embodiment is a generally round wire formed roughly into an elongate octagon with an open end and a closed end 17A (the open end forming one of the sides of the octagon). The closed end 17A is bent upward 90 degrees so that it fits into the notches 59 and over the tab 63 of one of the interconnected hinge plates 19, 21. The free end of the tab 63 is received behind the rim 25 of the housing so that the closed end 17A of the spring is held on the tab 63. The open end of each spring has two wire tips 98 that are each bent twice into a generally hook shape. A first bend is 90 degrees upward and a second bend is 90 degrees outward. These tips 98 releasably fit into the cutout 61 of the second interconnected hinge plate 19, 21 so that a body of the wire form spring 17 is positioned substantially beneath the interconnected plates 19, 21. As attached, the wire form springs 17 are relaxed when the hinge plates 19, 21 are oriented so that the ring members 41*a*, 41*b* are open. The body of the wire form spring 17 is bowed slightly upward (i.e., toward the interconnected plates 19, 21 (see FIG. 3B)) so that exterior surfaces of the interconnected hinge plates 19, 21 form an angle A that is less than 180° (i.e., the hinge plates' pivot axis is above a co-planar position of the hinge plates 19, 21). When the locking elements 51, 53, 55 move the hinge plates 19, 21 down and through the co-planar position for closing the ring members 41*a*, 41*b* (see FIG. 2B), each bowed wire form spring 17 flattens and becomes stressed. Conversely, when the locking elements 51, 53, 55 move into registration with respective openings 45, 47, 49 in the hinge plates 19, 21, the stressed wire form springs 17 automatically act on the hinge plates 19, 21 and pivot them up and through the co-planar position, opening the ring members 41*a*, 41*b*. It is understood that while the illustrated mechanism 1 includes two wire form springs 17, mechanisms having fewer than two or more than two wire form springs do not depart from the scope of this invention.

Now referring to FIGS. 2A-3B, 5, and 8-11, the control structure 15 is capable of selectively controlling the mechanism's movement between a closed and locked position and an open position. At the closed and locked position (FIGS. 2A, 2B, 5 and 8), the ring members 41*a*, 41*b* are together and cannot be pulled apart. In this position the hinge plates 19, 21 are oriented so that their pivot axis is slightly below the co-planar position and the angle A between their exterior surfaces is at its greatest. Additionally, the lever 31 is relatively vertical and the travel bar 65 is positioned closer to the housing end having the lever 31. As such, the first, second, and third locking elements 51, 53, 55 are positioned between the hinge plates 19, 21 and the housing 11, substantially out of registration with the respective openings 45, 47, 49 in the hinge plates 19, 21. In this travel bar locking position, the locking elements 51, 53, 55 firmly oppose any force tending to open the ring members 41*a*, 41*b* because they are generally sized, along with the travel bar 65, to fully occupy the area between the hinge plates 19, 21 and the housing's raised plateau 23. So as the hinge plates 19, 21 push up on the locking elements 51, 53, 55 (i.e., such as when the hinge plates 19, 21 pivot to open the ring members 41*a*, 41*b*) the hinge plates immediately engage the locking elements 51, 53, 55, tending to force both the locking elements 51, 53, 55 and the travel bar 65 up. The housing's raised plateau 23 resists this movement, however, blocking the hinge plates' pivoting motion and preventing the ring members 41*a*, 41*b* from opening.

In order to open the mechanism 1, an operator pivots the lever 31 outward and downward (FIG. 9). This pushes the intermediate connector 79 and travel bar 65 away from the housing end having the lever 31, and translates the travel bar 65 out of its locking position. The travel bar 65 moves until the locking elements 51, 53, 55 each substantially register with the respective second, third, and fourth openings 45, 47, 49 in the hinge plates 19, 21. At this intermediate, transitional position, the locking elements 51, 53, 55 no longer block the hinge plates' pivoting motion. This allows the wire form springs 17 to automatically act on the hinge plates 19, 21, pivoting the hinge plates 19, 21 up and through the co-planar position (and thereby overcoming any spring force of the housing 11 that resists hinge plate movement through the co-planar position) so that their openings 45, 47, 49 pass over the locking elements 51, 53, 55 and the ring members 41*a*, 41*b* open. At this open position (FIGS. 3A, 3B, 10 and 11), the cam surfaces 99 of each locking element 51, 53, 55 fully project through the hinge plates' respective openings 45, 47, 49 and the angle A between the hinge plates' exterior surfaces is at its smallest. The wire form springs 17 and the housing's spring force keep the ring members 41*a*, 41*b* open, and the operator may let go of the lever 31 to load or remove paper from the mechanism 1.

To return the mechanism 1 back to the closed and locked position, the operator pivots the lever 31 inward and upward (FIGS. 2A, 5, and 8). This pulls the intermediate connector 79 and travel bar 65 back toward the housing end mounting the lever 31, causing the cam surfaces 99 of the locking elements to engage the hinge plates 19, 21 at edges of the respective openings 45, 47, 49. As the operator continues pivoting the lever 31 and moving the travel bar 65, the locking elements 51, 53, 55 begin to pivot the hinge plates 19, 21, thereby overcoming forces opposing such hinge plate 19, 21 motion (i.e., a sliding friction force between the locking elements' cam surfaces 99 and the hinge plates 19, 21, the wire form spring's force resisting flattening, and the housing's spring force resisting hinge plate movement through the co-planar position). Thus, the hinge plates 19, 21 slowly slide down each cam surface 99 and softly move the ring members 41*a*, 41*b* together. Once the ring members 41*a*, 41*b* fully close, the travel bar 65 returns to its locking position and the locking elements 51, 53, 55 fully return to their position blocking the hinge plates' pivoting motion fully behind the hinge plates. As above described, in this mechanism 1 the locking elements 51, 53, 55 bias the hinge plates 19, 21 to pivot only for closing and locking the ring members 41*a*, 41*b*. The locking elements 51, 53, 55 are incapable of moving the hinge plates 19, 21 for opening the ring members 41*a*, 41*b*. This is accomplished by the wire form springs 17.

The ring binder mechanism of the present invention securely retains loose-leaf pages when the ring members 41*a*, 41*b* are closed. In this position, the locking elements 51, 53, 55 and travel bar 65 generally completely occupy the area between the hinge plates 19, 21 and the housing's raised plateau 23, and the locking elements 51, 53, 55 are positioned substantially out of registration with the respective openings 45, 47, 49 in the hinge plates 19, 21. Additionally, the housing 11 encases the locking elements 51, 53, 55, providing a barrier to outside forces from unintentionally moving the locking elements 51, 53, 55 into registration with the openings 45, 47, 49. As a result, the travel bar 65 and the locking elements 51, 53, 55 fully resist any hinge plate movement tending to open the ring members 41*a*, 41*b* and positively lock the ring members 41*a*, 41*b* together, reducing the mechanism's chance of accidentally opening. This holds the free ends of the closed paired ring members 41*a*, 41*b* together so that the interlocking configurations 56*a*, 56*b* of the ring members remain interengaged.

This mechanism is easier to manipulate when the ring members 41*a*, 41*b* are full of pages. The lever 31 can move the locking elements 51, 53, 55 for unlocking the ring members 41*a*, 41*b*, as opposed to prior art mechanisms where the ring members themselves directly lock together. Furthermore, the locking elements 51, 53, 55 of this mechanism distribute a locking force generally uniformly to the ring members 41*a*, 41*b* and minimize gaps between the closed members 41*a*, 41*b* because the locking elements 51, 53, 55 are uniformly spaced along the length of the hinge plates 19, 21.

This mechanism 1 also reduces the undesirable snapping motion of ring members 41*a*, 41*b* as they close because the locking elements' cam surfaces 99 control the pivoting motion of the hinge plates 19, 21. As the operator pivots the lever 31 for closing the ring members 41*a*, 41*b*, the locking elements 51, 53, 55 slowly move the hinge plates 19, 21 and gently bring the ring members 41*a*, 41*b* together. The wire form springs 17 cause the hinge plates 19, 21 to pivot up and through the co-planar position for opening the ring members 41*a*, 41*b*. As such, the wire form springs 17 effectively perform the same functions as the housing's spring force. Consequently, the housing's spring force may be reduced, or possibly eliminated, so that only the wire form springs 17 act on the hinge plates 19, 21. This makes it easier to move the hinge plates 19, 21 down and through the co-planar position when closing the ring members 41*a*, 41*b*.

Furthermore, this mechanism 1 opens more easily than prior art mechanisms. The operator need only move the travel bar 65 a short distance before its locking elements 51, 53, 55 align with corresponding openings 45, 47, 49 in the hinge plates 19, 21 and the wire form springs 17 automatically act on the hinge plates 19, 21, pivoting them to open the ring members 41*a*, 41*b*. Similarly, the lever's pivoting movement reduces the magnitude of force necessary to cause this travel bar movement because of the mechanical advantage given by the lever 31.

Figure 12:
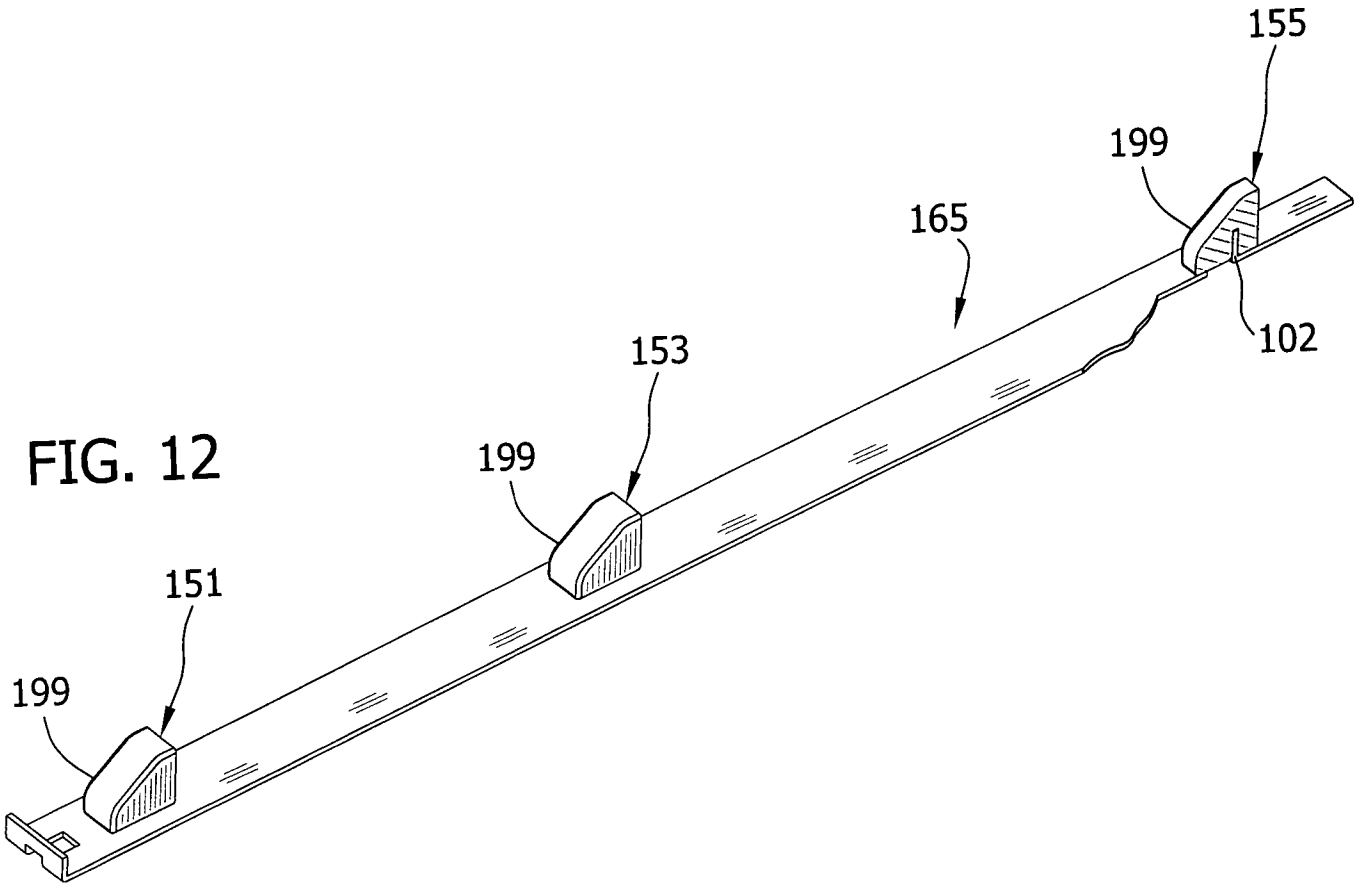
FIG. 12 is a bottom perspective of an alternative version of the travel bar with a portion of the travel bar and a portion of a locking element broken away.
Figure 13A:
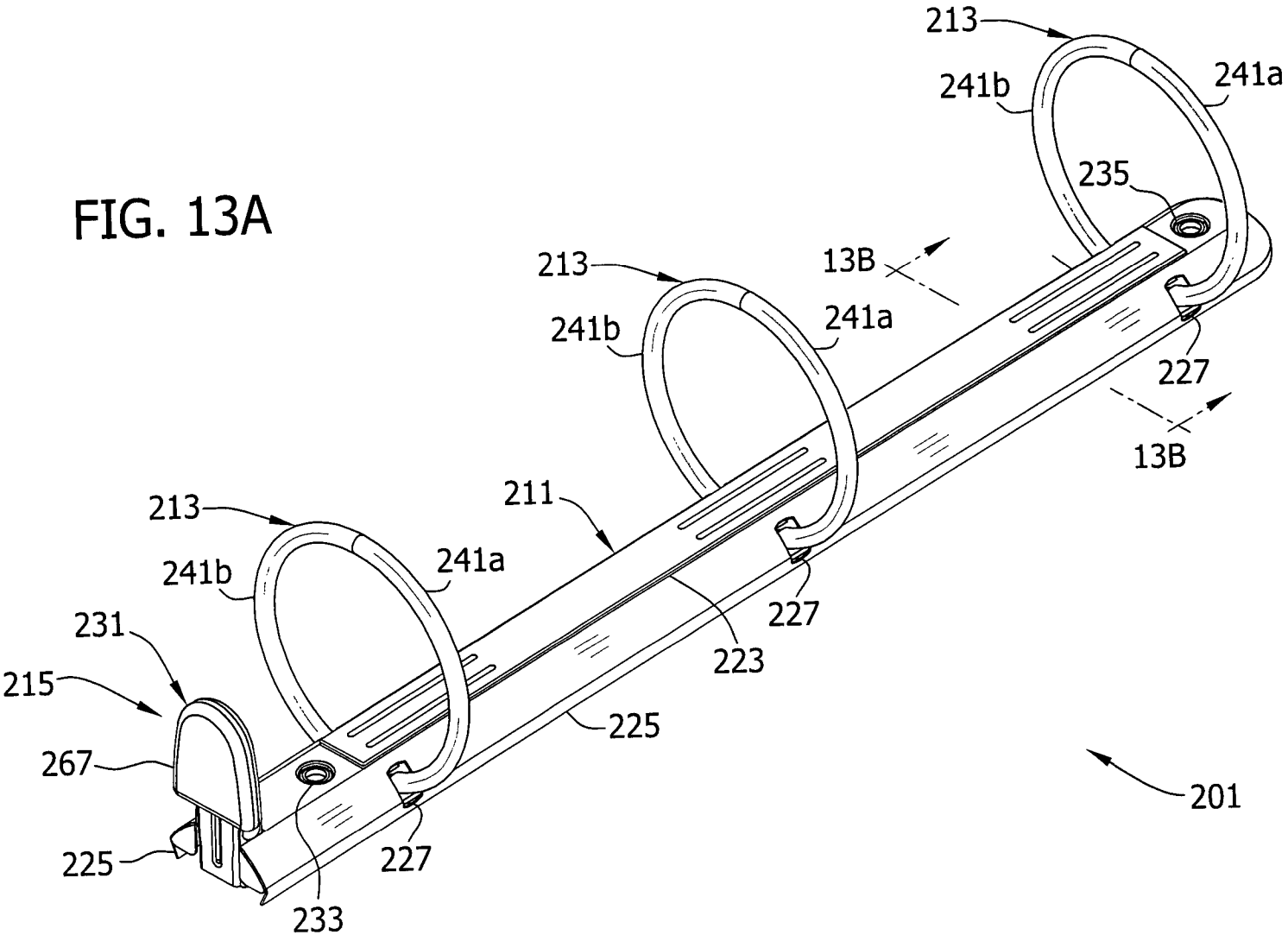
FIG. 13A is a perspective of a second embodiment of a ring binder mechanism of the present invention at a closed and locked position.
Figure 13B:
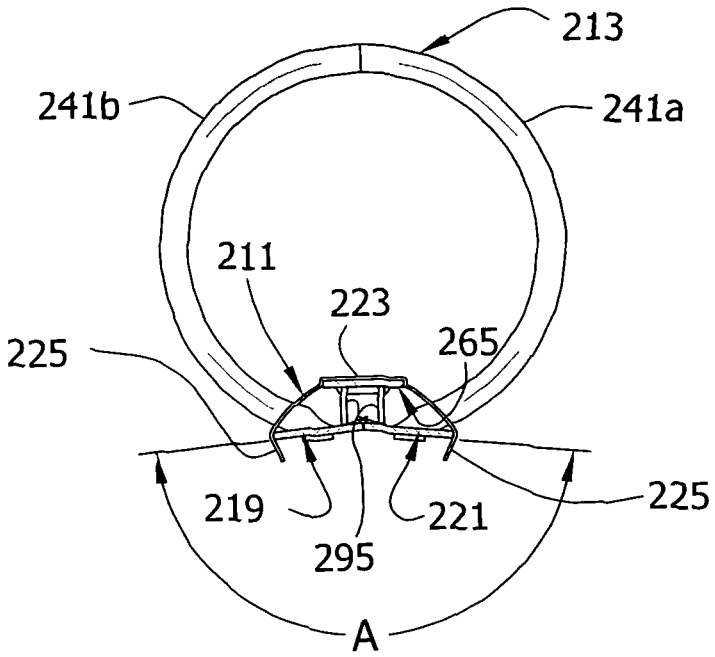
FIG. 13B is a section taken in the plane of line 13B-13B of FIG. 13A.
Figure 14A:
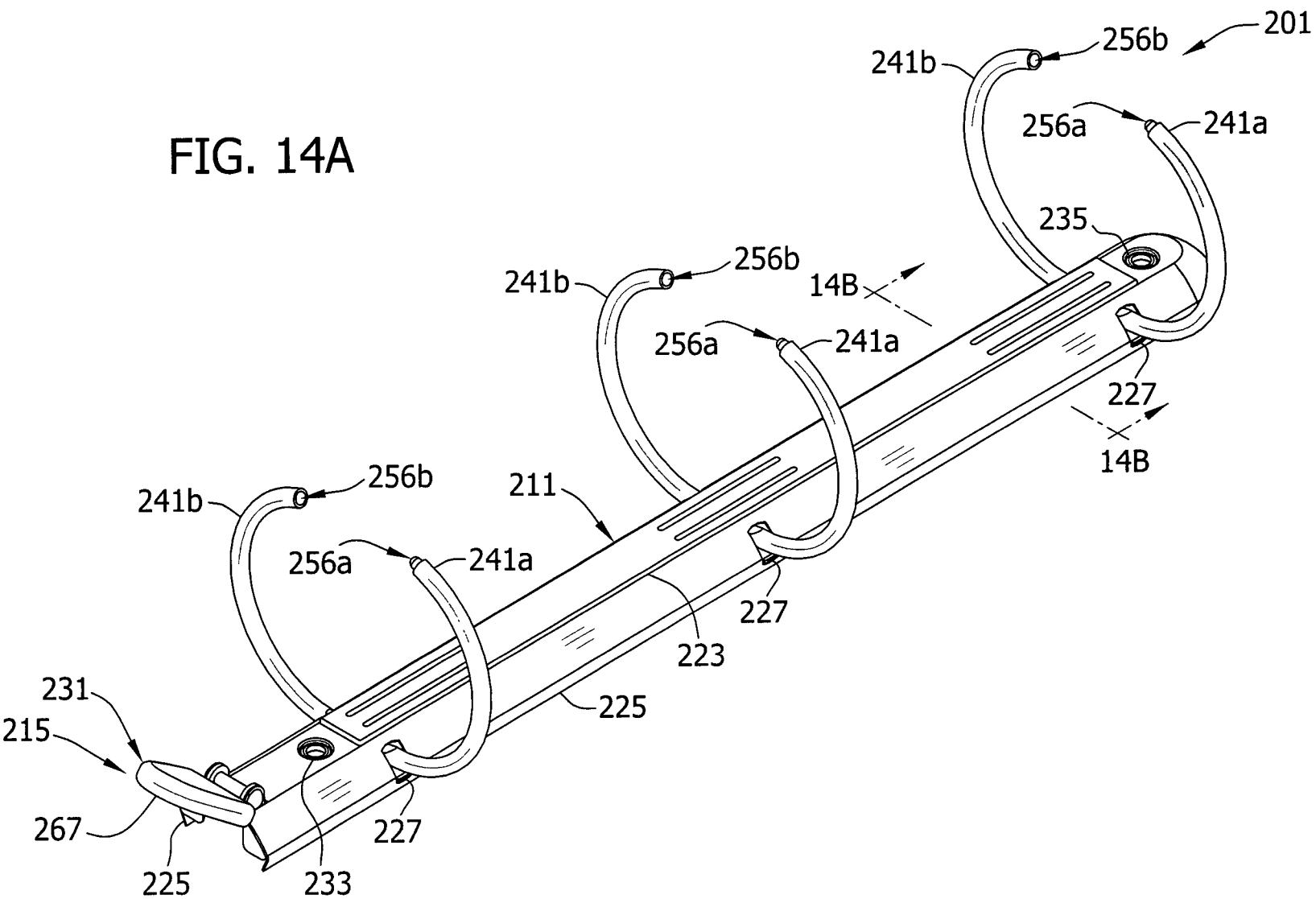
FIG. 14A is a perspective similar to FIG. 13A with the mechanism at an open position.
Figure 14B:
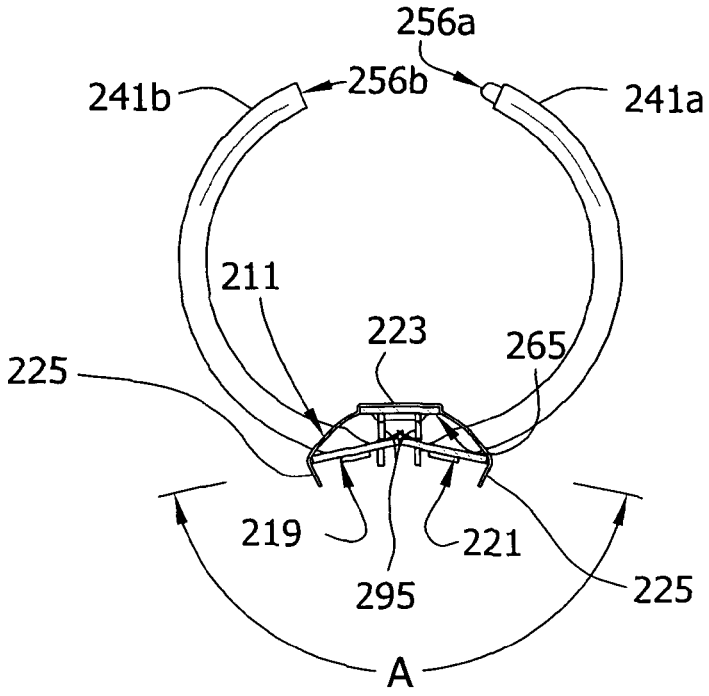
FIG. 14B is a section taken in the plane of line 14B-14B of FIG. 14A.

Now referring to FIG. 12, an alternative version of the travel bar is generally designated by reference numeral 165. This travel bar 165 includes three tabs 102 (only one of which is shown) formed as one piece with the travel bar 165. Each tab 102 is struck downward 90 degrees from the bar's surface and is capable of receiving one of three locking elements 151, 153, 155, which in this embodiment are formed separately from the travel bar 165 and secured to their respective tab 102 (only one is shown in FIG. 12). The locking elements 151, 153, 155 are generally block-shaped and may be made of plastic or other suitable material capable of resisting the hinge plates' pivoting motion and of wedging the hinge plates to move the ring members mounted thereon together. The locking elements 151, 153, 155 also each include an angled cam surface 199 substantially similar to the cam surfaces 99 of the travel bar 65 described for the mechanism 1 of the first embodiment. Accordingly, each embodiment described herein may include this alternative version travel bar 165.

FIGS. 13A-14B illustrate a ring binder mechanism according to a second embodiment of this invention. The mechanism of this embodiment is generally designated by reference numeral 201. Parts of the mechanism of this second embodiment corresponding to parts of the mechanism of the first embodiment are indicated by the same reference numerals, plus "200". This embodiment is substantially similar to the first embodiment, but does not include wire form springs under hinge plates. In this embodiment a spring force of a housing 211 causes the hinge plates 219, 221 to pivot for opening ring members 241*a*, 241*b*. The hinge plates 219, 221 pivot in the housing 211 so that a pivot axis never moves below a co-planar position when the ring members 241*a*, 241*b* move between a closed and an open position (i.e., an angle A (FIGS. 13B and 14B) between exterior surfaces of the hinge plates is always less than 180 degrees). Thus, the spring force of the housing 211 only acts to open the ring members 241*a*, 241*b* and never to close the ring members. Also in this embodiment, the hinge plates 219, 221 do not include notches or a cutout along their outer longitudinal edge margins because there are no wire form springs. But in all other aspects, the hinge plates 219, 221 of this embodiment are identical to the hinge plates 19, 21 of the first embodiment.

Figure 15:
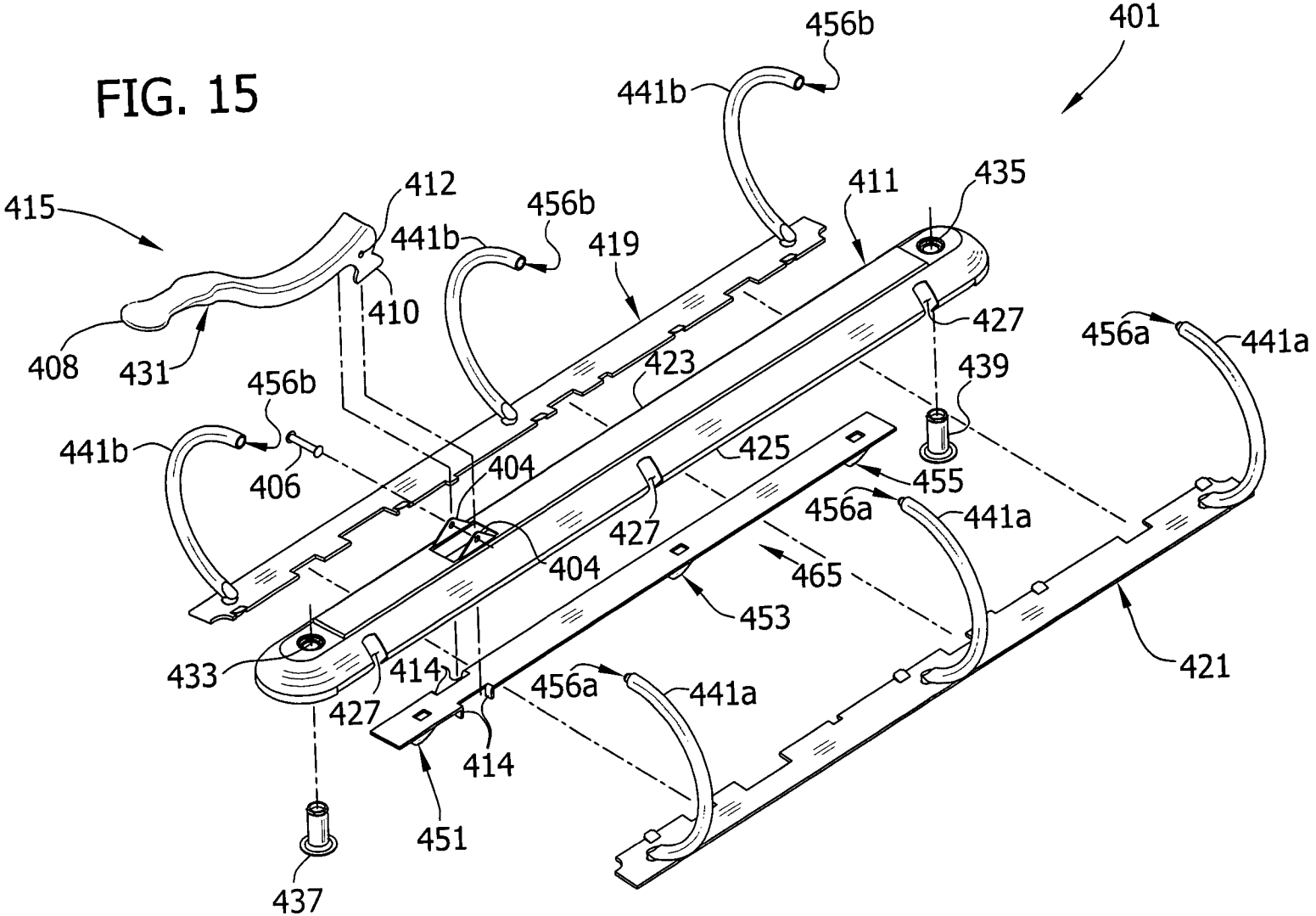
FIG. 15 is an exploded perspective of a ring binder mechanism of the present invention according to a third embodiment.
Figure 16A:
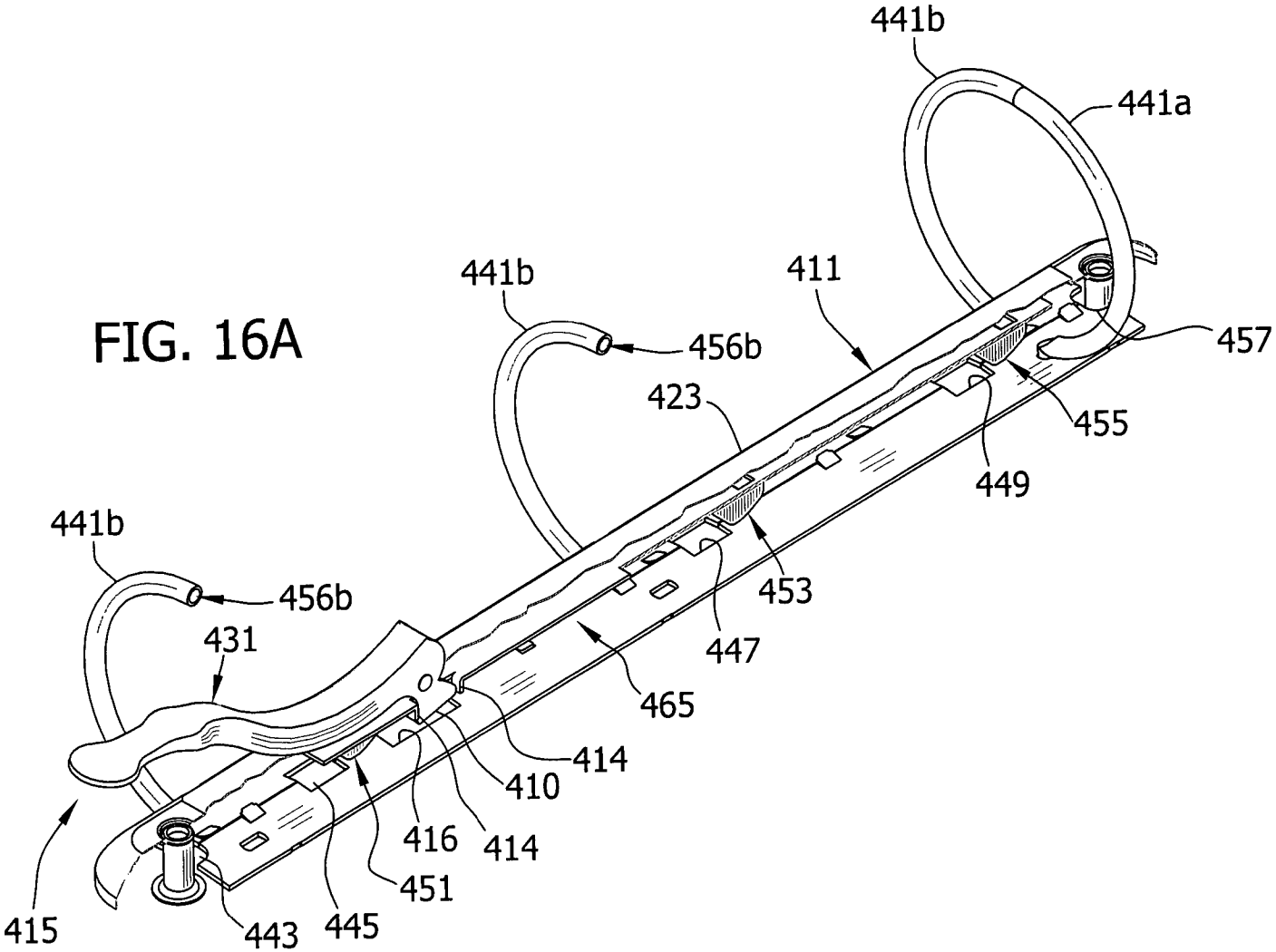
FIG. 16A is a perspective of the mechanism of FIG. 15 at a closed and locked position with a portion of a housing, a travel bar, locking elements, and two ring members broken away.
Figure 16B:
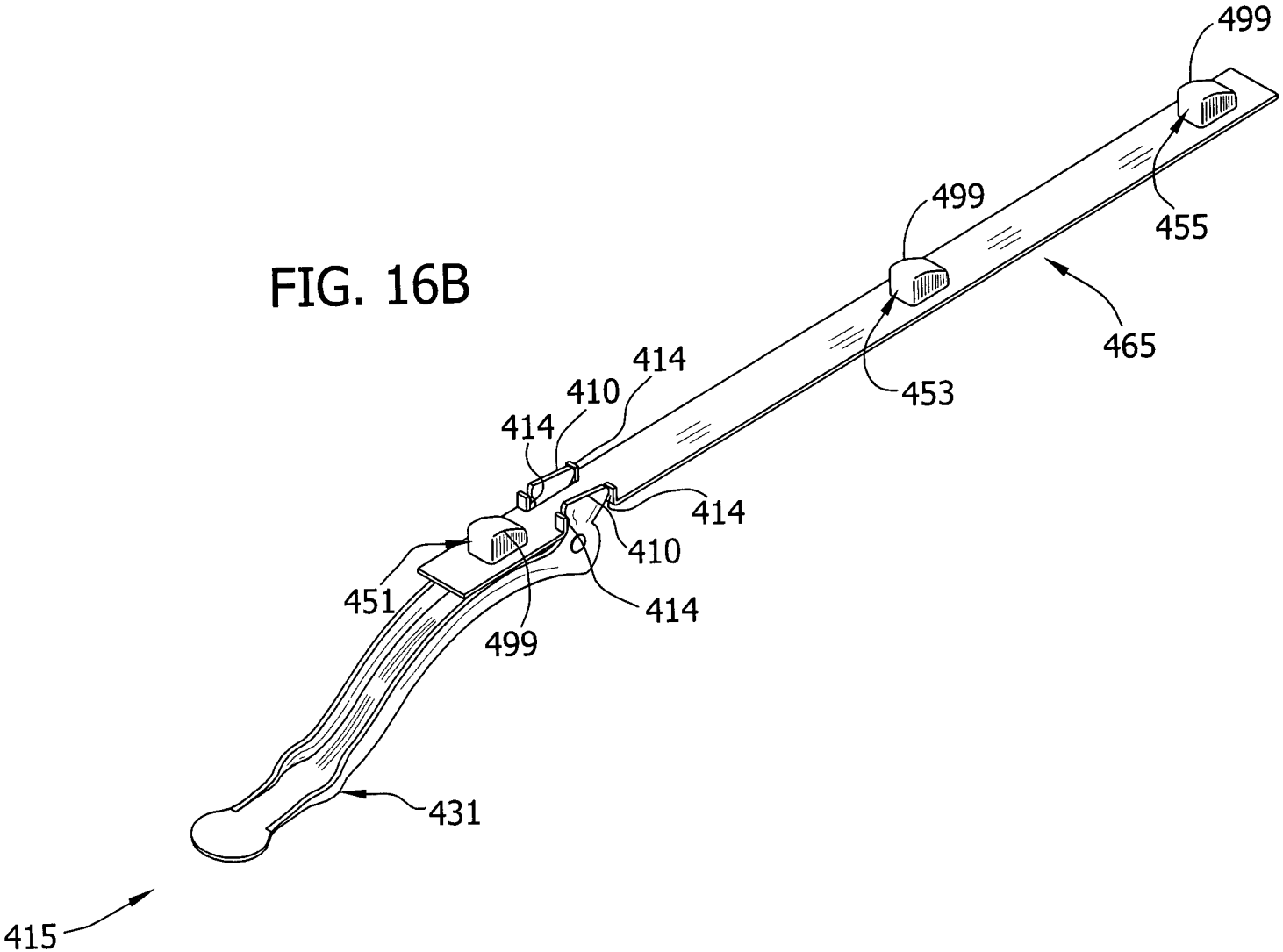
FIG. 16B is a bottom perspective of a control structure of the mechanism.
Figure 17:
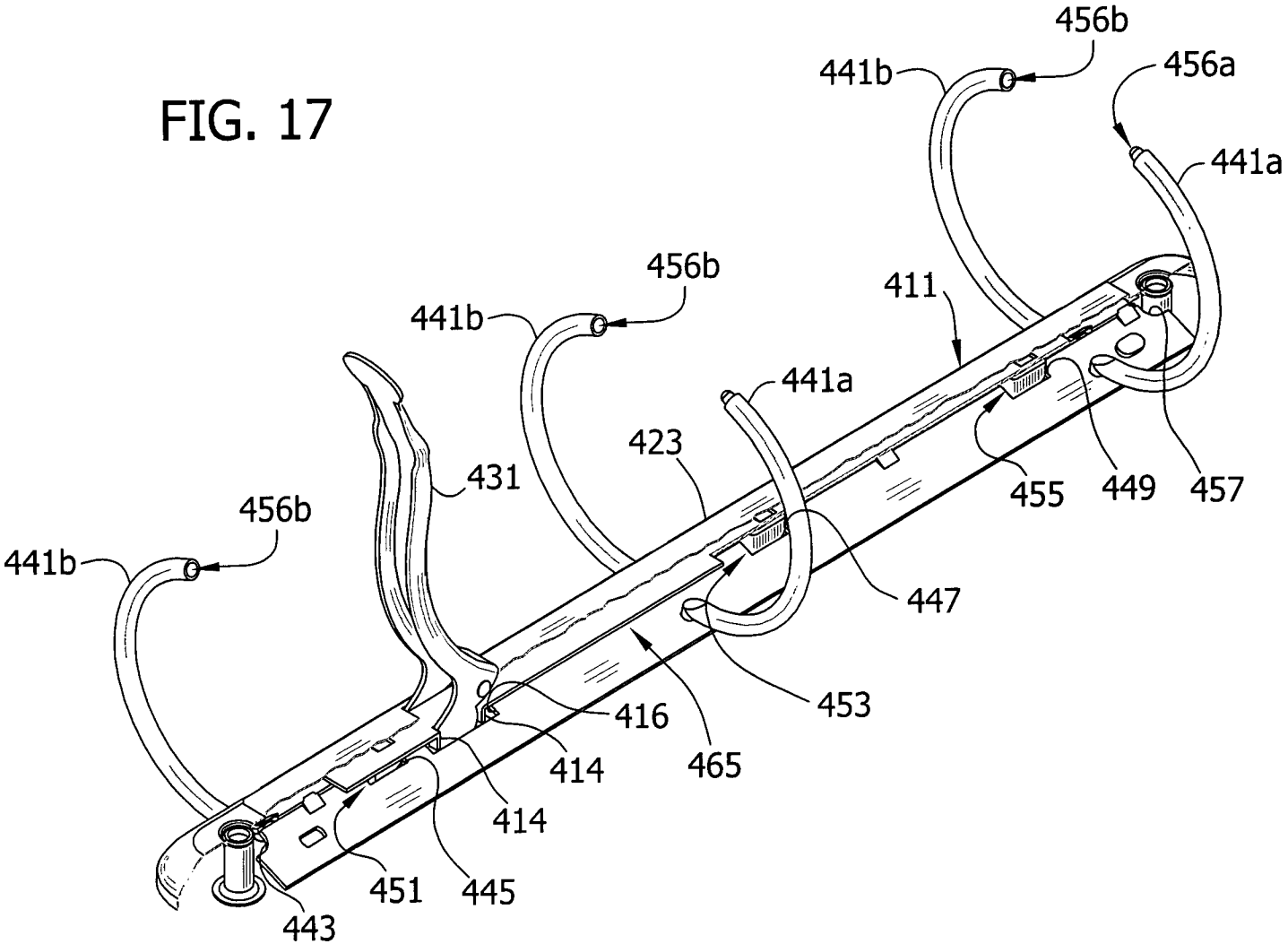
FIG. 17 is a perspective similar to FIG. 16A with the mechanism at an open position.

FIGS. 15-17 illustrate a ring mechanism according to a third embodiment of this invention. The mechanism of this invention is generally designated by reference numeral 401. Parts of this embodiment which correspond to parts of the first embodiment are indicated by the same reference numerals, plus "400". This embodiment is similar to the second embodiment in that a housing 411 supports hinge plates 419, 421 for pivoting motion such that a pivot axis of the hinge plates 419, 421 never moves to or below a co-planar position when ring members 441 move between a closed and locked position and an open position. In this embodiment, however, a lever 431 of a control structure 415 is located between two symmetrical ends of the housing 411. To accommodate this, the housing 411 includes two tabs 404, extending upward from a raised plateau 423 of the housing. The tabs 404 are capable of receiving a hinge pin 406 for pivotally mounting the lever 431 on the housing 411. In this embodiment, the lever 431 is generally an elongate, bowed beam that includes a web and two downward turned side flanges. At one end, the side flanges taper into the web, forming a flat surface 408 to grasp and pivot the lever 431. At the other end, cam surfaces 410 project downward from the side flanges. Also at this end, a hole 412 passes through both side flanges for receiving the hinge pin 406 that mounts the lever 431 on the housing 411.

The mechanism 401 of this embodiment uses no intermediate connector to transfer the lever's pivoting movement into linear movement of a travel bar. Instead, the lever's cam surfaces 410 loosely fit between opposing shoulders 414 formed in the travel bar 465 so that the lever's pivoting movement directly translates the travel bar 465 relative to the housing 411. The loose reception of each cam surface 410 between a respective pair of shoulders 414 allows the cam surfaces to pivot and yet bear against one or the other of the shoulders for linearly moving the travel bar 465. The shoulders 414 are located toward one end of the travel bar 465, along longitudinal edge margins of the travel bar, and are positioned so that one of the shoulders 414 is directly opposite the other. Each shoulder 414 is formed by bending two opposing pieces downward 90 degrees so that a plane of each piece is perpendicular to the travel bar 465. In this embodiment the travel bar 465 does not include an end flange or a slot because there is no intermediate connector for it to receive.

Referring particularly to FIGS. 16A-17, operation of this embodiment is substantially similar to the operation of the second embodiment. In this embodiment, however, at a closed and locked position of FIG. 16A, the lever 431 is relatively horizontal and generally parallel to the housing's raised plateau 423. In order to open the ring members 441, an operator pivots the lever 431 upward and inward (i.e., toward the center pair of ring members 441). The lever's cam surfaces 410 engage the travel bar's shoulders 414 and linearly move the travel bar 465 toward the lever 431. This moves locking elements 451, 453, 455 into registration with respective openings 445, 447, 449 in the hinge plates, allowing the housing's spring force to pivot the hinge plates 419, 421 and open the ring members 441. The hinge plates 419, 421 include an additional opening 416 between second and third openings 445, 447 for receiving the lever's cam surfaces 410 and the travel bar's shoulders 414 through the interconnected plates 419, 421 (FIG. 17). Accordingly, there is no interference between the hinge plates 419, 421 and either the lever 431 or the travel bar 465 during operation. To close the ring members 441, the operator pivots the lever 431 downward and outward, reversing the opening action, so that the cam surfaces 410 again bear against the shoulders 414 to move the travel bar 465 away from the lever 431. As in the second embodiment, cam surfaces 499 of each locking element 451, 453, 455, which in this embodiment are identical to the cam surfaces 199 of the locking elements described for the alternative version of the travel bar 165 above, engage the hinge plates 419, 421 and cause them to pivot to close the ring members 441. It is understood that while in this embodiment the housing's spring force pivots the hinge plates 419, 421 for opening the ring members 441, wire form springs may alternatively be attached to the underside of hinge plates for pivoting the plates as was described for the first embodiment.

FIGS. 18-21 illustrate a fourth embodiment of the ring binder mechanism of the invention. The mechanism of this embodiment is indicated generally by reference numeral 501. It is substantially similar to the ring mechanism 1 of the first embodiment, with the exception of control structure (designated generally 515) and of operation of the mechanism 501 between a closed position and an open position.

Figure 18:
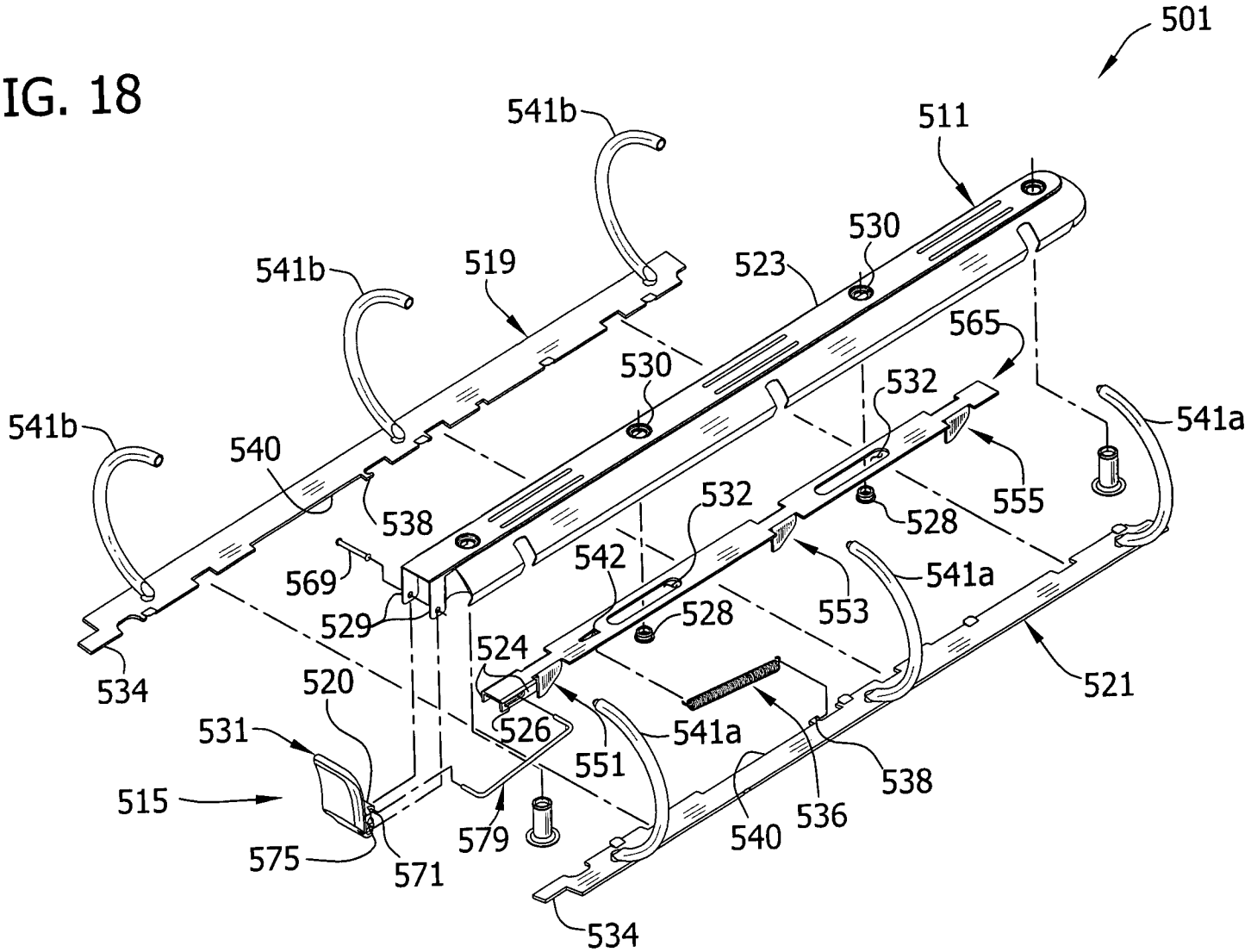
FIG. 18 is an exploded perspective of a ring binder mechanism according to a fourth embodiment of the invention.
Figure 21:
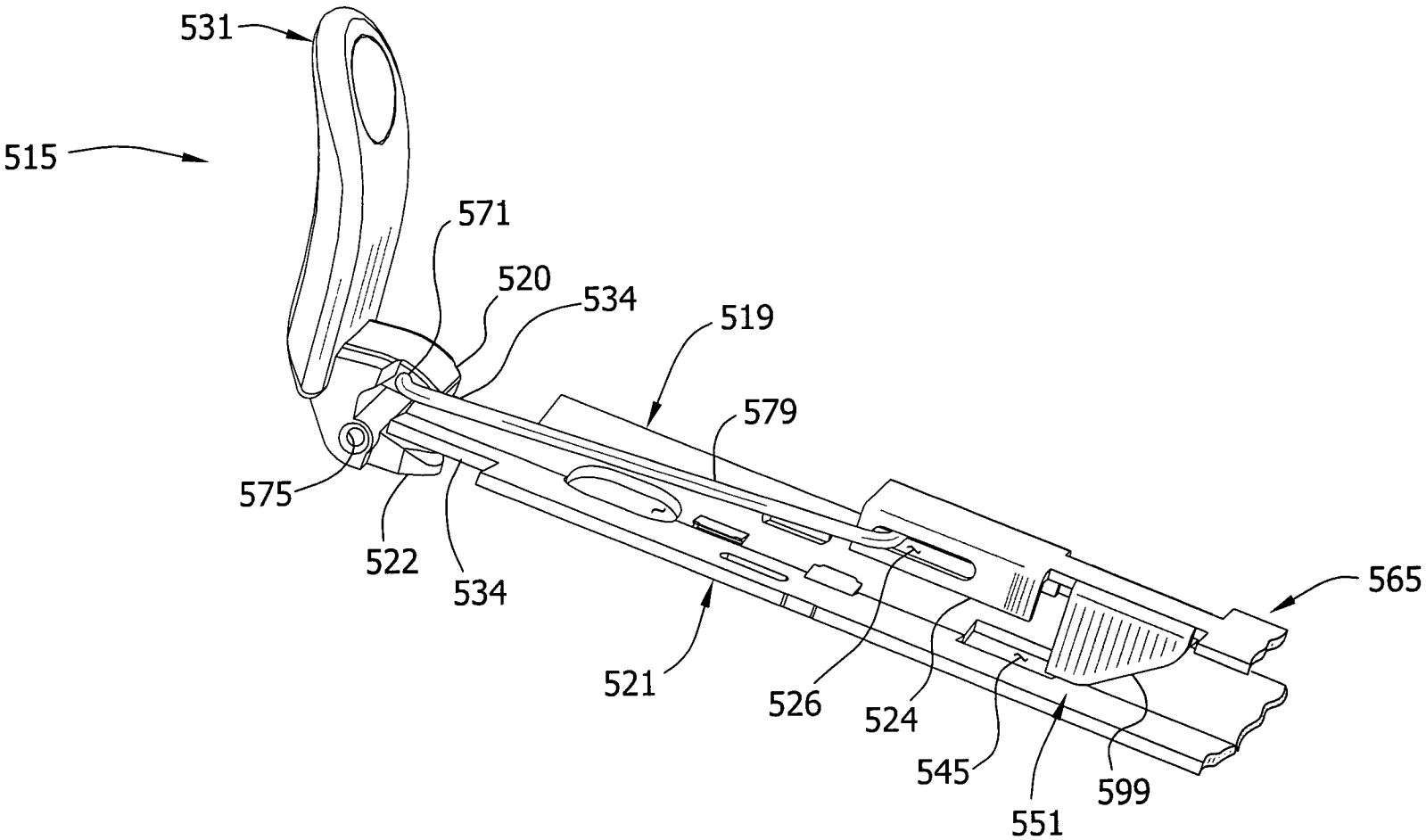
FIG. 21 is a fragmentary perspective of a control structure of the ring mechanism of FIG. 18 illustrated in combination with hinge plates of the mechanism.

As best shown in FIGS. 18 and 21 and as previously described and illustrated for the previous embodiments, the control structure 515 includes a lever (designated generally 531), an intermediate connector (designated generally 579), and a travel bar (designated generally 565). The lever 531 is similar to the lever of the previous embodiments, but includes a closing arm 520 and an opening arm 522. The two arms extend away from the lever 531 in generally perpendicular orientation and are generally parallel to one another in spaced apart relation. The intermediate connector 579 is formed from a thin wire having two ends both bent 90 degrees in the same direction (FIG. 18). The connector 579 will be described in greater detail hereinafter.

Figure 19:
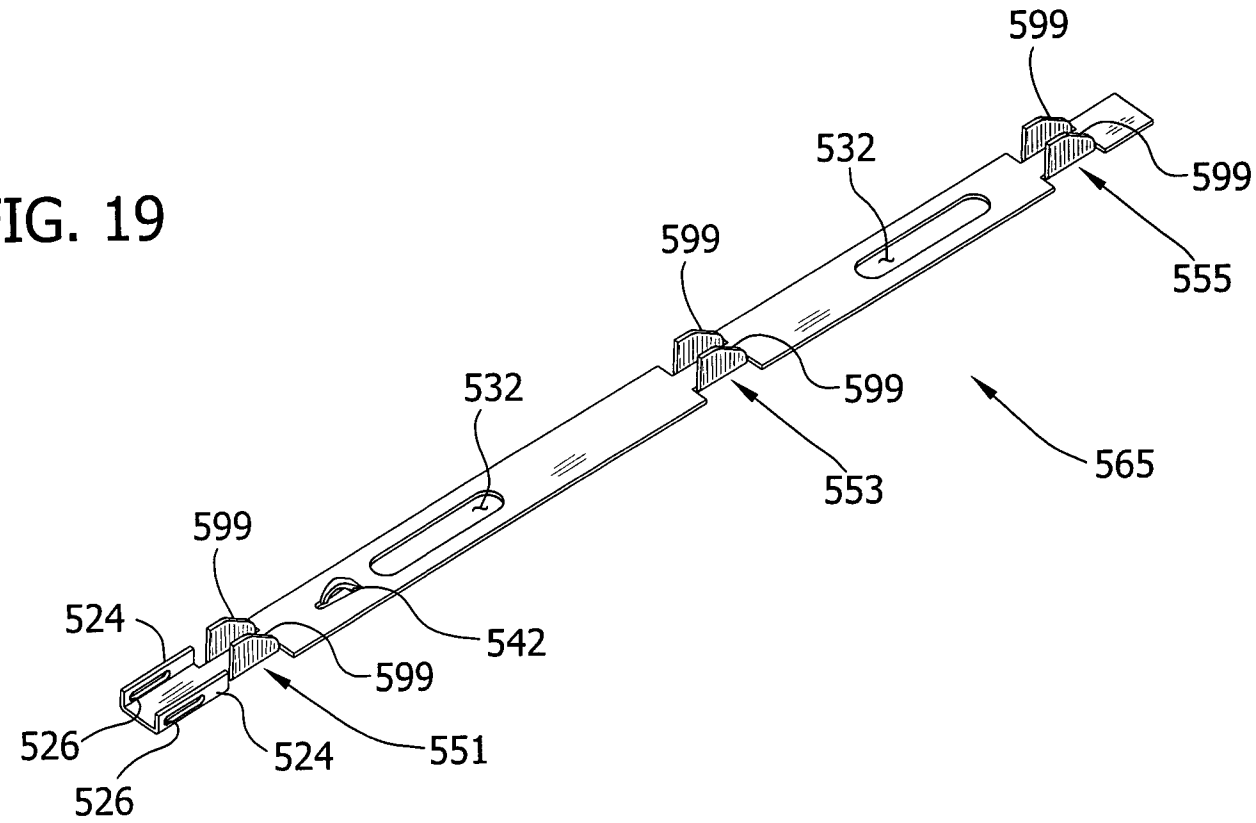
FIG. 19 is an enlarged and inverted perspective of a travel bar of the ring mechanism of FIG. 18.

As best shown in FIGS. 18 and 19, the travel bar 565 of this embodiment is substantially similar to the travel bar 65 of the first embodiment of FIGS. 1-12, but includes flanges 524 extending along each longitudinal edge margin between first locking element 551 and the end of the travel bar 565 nearest the lever 531. Both flanges 524 include an elongate opening 526 (only one opening is visible) therein, the purpose of which will be described hereinafter. It is envisioned that the side flanges 524 are formed by bending a section of both longitudinal edge margins of the travel bar 565 downward 90 degrees. Other methods of forming flanges may be used without departing from the scope of the invention. Locking elements 551, 553, 555 of the travel bar 565 are also modified in that cam surfaces 599 face away from the lever 531 for each locking element (i.e., are positioned on a side of each locking element furthest from the lever).

Figure 20:
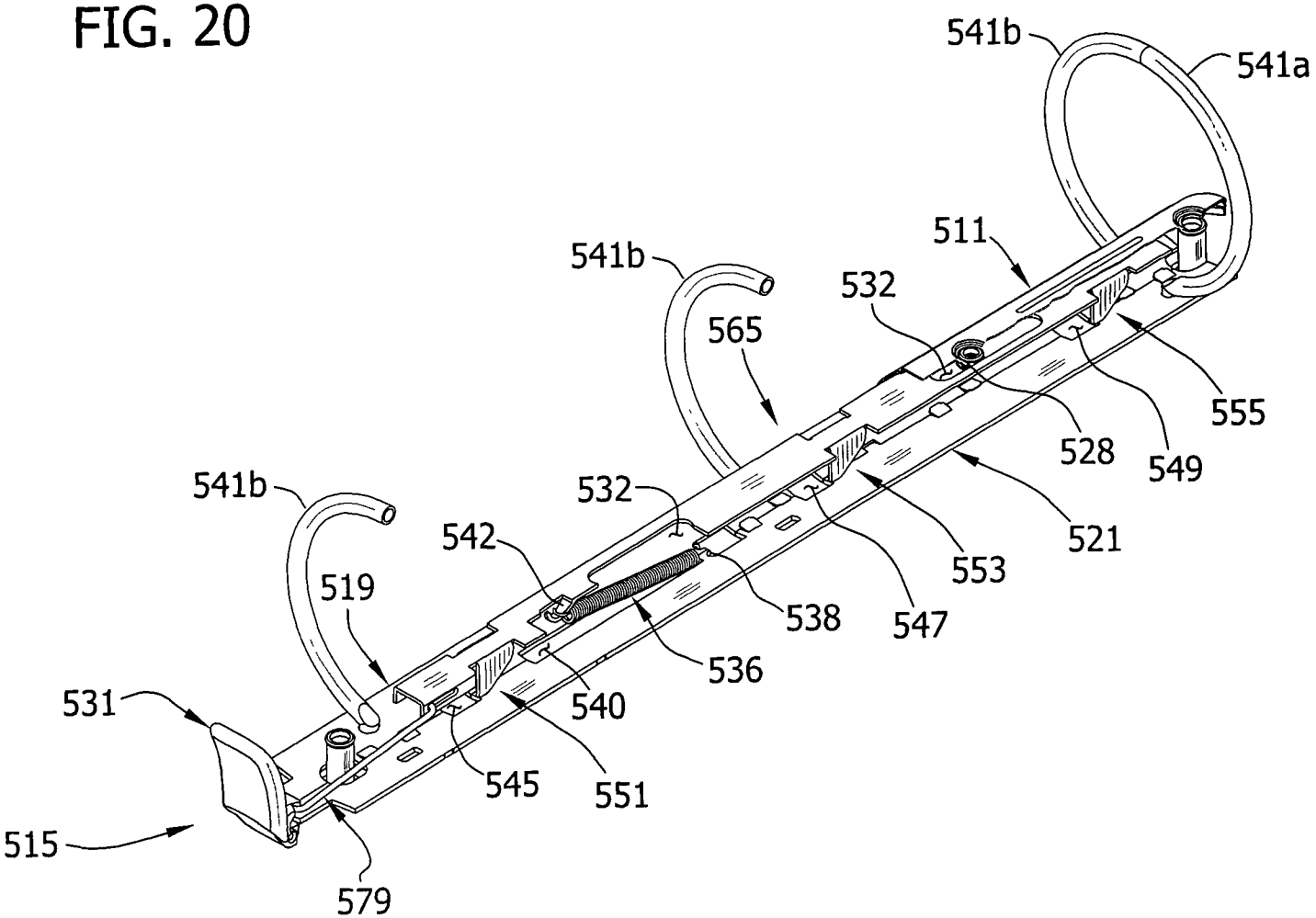
FIG. 20 is a perspective of the ring mechanism of FIG. 18 with components of the ring mechanism broken away to show internal construction.

The assembled ring binder mechanism 501 of this embodiment will be described with reference to FIGS. 20 and 21. The assembled mechanism 501 is substantially similar to the assembled mechanism 1 of FIGS. 1-12, with the following exceptions. The lever 531 pivotally attaches to housing 511 at tabs 529 (FIG. 18) projecting downward from an open end of the housing. A hinge pin 569 passes through aligned openings in the tabs 529 and through a lower opening 575 adjacent the opening arm 522 of the lever 531 to operatively mount the lever on the housing 511.

The travel bar 565 is disposed under raised plateau 523 of the housing 511. Two grooved rivets 528 are secured in openings 530 in the raised plateau 523 and pass through respective elongate openings 532 in the travel bar 565 to slidably mount the travel bar on the housing 511. This permits the travel bar 565 to slide longitudinally of the housing 511 and relative to the rivets 528, and minimizes vertical movement of the travel bar 565 and locking elements 551, 553, 555 during operation. This beneficially prevents the locking elements 551, 553, 555 from engaging a notebook's spine when the mechanism 501 is at an open position.

The travel bar 565 connects to the lever 531 via the intermediate connector 579. One end of the connector 579 is received in an aperture 571 in the closing arm 520 of the lever 531, and the other end of the connector is received in the elongate opening 526 of one of the two side flanges 524 of the travel bar 565. It is feasible that two intermediate connectors 579 could be employed with one connector positioned in respective ones of the elongate openings 526 of the side flanges 524, but it is understood that when one intermediate connector is used, it can be positioned in an elongate opening of either side flange without departing from the scope of this invention. Similarly, mechanisms having only one slot or only one side flange do not depart from the scope of this invention.

As best shown in FIG. 21, end fingers 534 of each hinge plate 519, 521 extend away from a longitudinal end of each hinge plate and position between the opening arm 522 and closing arm 520 of the lever 531. In addition in this embodiment, a coiled extension spring 536 is disposed generally between the hinge plates 519, 521 and travel bar 565, and between the first and second locking elements 551, 553 of the travel bar. One end of the spring 536 attaches to the hinge plates 519, 521 at a hook 538 located generally along an inner longitudinal edge margin of one of the hinge plates. As the hinge plates 519, 521 are assembled in the ring mechanism 501, the hook 538 is adjacent the pivot axis of the plates. Spring cutouts 540 are formed in the hinge plates 519, 521 along their inner longitudinal edge margins such that when the hinge plates interconnect, the cutouts align to form a cutout opening 540 adjacent the hook 538. The cutout opening 540 accommodates the spring 536 when it connects to the hinge plates 519, 521. The opposite end of the spring 536 attaches to the travel bar 565 at a detent 542 struck downward from the travel bar. In this position, the spring 536 is oriented to bias the travel bar 565 and locking elements 551, 553, 555 away from the lever 531.

Operation of the ring mechanism 501 of this embodiment will be described with reference to FIGS. 20 and 21. Operation is generally the same as was described for the first embodiment of FIGS. 1-12. At a closed and locked position (FIGS. 20 and 21), the hinge plates 519, 521 are oriented with a pivot axis below their a co-planar position, ring members 541*a*, 541*b* are closed, and the travel bar 565 and locking elements 551, 553, 555 are positioned relatively away from the lever 531 (as compared to their positions in the first embodiment (e.g., FIG. 5)) completely out of registration with respective cutout openings 545, 547, 549 (FIG. 20) of the hinge plates 519, 521, between the hinge plates and the housing 511.

Pivoting the lever 531 to open the ring mechanism 501 pulls the intermediate connector 579, travel bar 565, and locking elements 551, 553, 555 toward the lever and into registration with respective cutout openings 545, 547, 549 (FIG. 20) in the interconnected hinge plates 519, 521. This stretches the coil spring 536 and creates a force in the spring tending to urge the travel bar 565 and locking elements 551, 553, 555 back to their locked position. The hinge plates 519, 521 do not automatically pivot in this embodiment, however, because the housing spring force holds the hinge plates' pivot axis below the co-planar position. Once the locking elements 551, 553, 555 move into registration with openings 545, 547, 549, the lever's opening arm 522 comes into engagement with lower surfaces of the hinge plate's fingers 534 and begins pushing the hinge plates 519, 521 upward. The hinge plates move over the locking elements 551, 553, 555 at each respective cutout opening 545, 547, 549 in the plates 519, 521 and pivot upward and through their co-planar position to open the ring members 541*a*, 541*b*. If the lever 531 is released before the ring members 541*a*, 541*b* open, the spring 536 immediately urges the travel bar 565 and locking elements 551, 553, 555 back to their locked position, which pulls the lever 531 back to its upright position.

It should be understood that the lever 531 is formed so that when the hinge plates 519, 521 are between the opening arm 522 and closing arm 520, a small gap exists between the opening arm and the lower surface of the hinge plate fingers 534 when the ring mechanism 501 is closed and locked. This allows the lever 531 to pivot and pull the travel bar 565 and locking elements 551, 553, 555 out of their locked position and into registration with the cutout openings 545, 547, 549 of the hinge plates 519, 521 before the opening arm 522 engages and pivots the hinge plates.

To close the ring mechanism 501, either the ring members 541*a*, 541*b* can be pushed together or the lever 531 can be pivoted upward and inward. Pivoting the lever 531 causes its closing arm 520 to engage upper surfaces of the hinge plates' fingers 534 and slowly pivot the hinge plates 519, 521 downward and through their co-planar position. At the same time, the lever 531 pushes the travel bar 565 and locking elements 551, 553, 555 away from the lever 531 so that the cam surfaces 599 of the locking elements 551, 553, 555 engage the hinge plates 519, 521 at edges of the respective cutout openings 545, 547, 549. But the locking elements provide substantially no cam force to push the hinge plates 519, 521 downward through their co-planar position. The primary force to close the hinge plates 519, 521 comes from the closing arm 520 of the lever 531. Once the hinge plates 519, 521 clear the locking elements 551, 553, 555, the spring 536 immediately contracts and automatically pulls the travel bar 565 and locking elements 551, 553, 555 away from the lever 531 and to their locked position.

Figure 22:
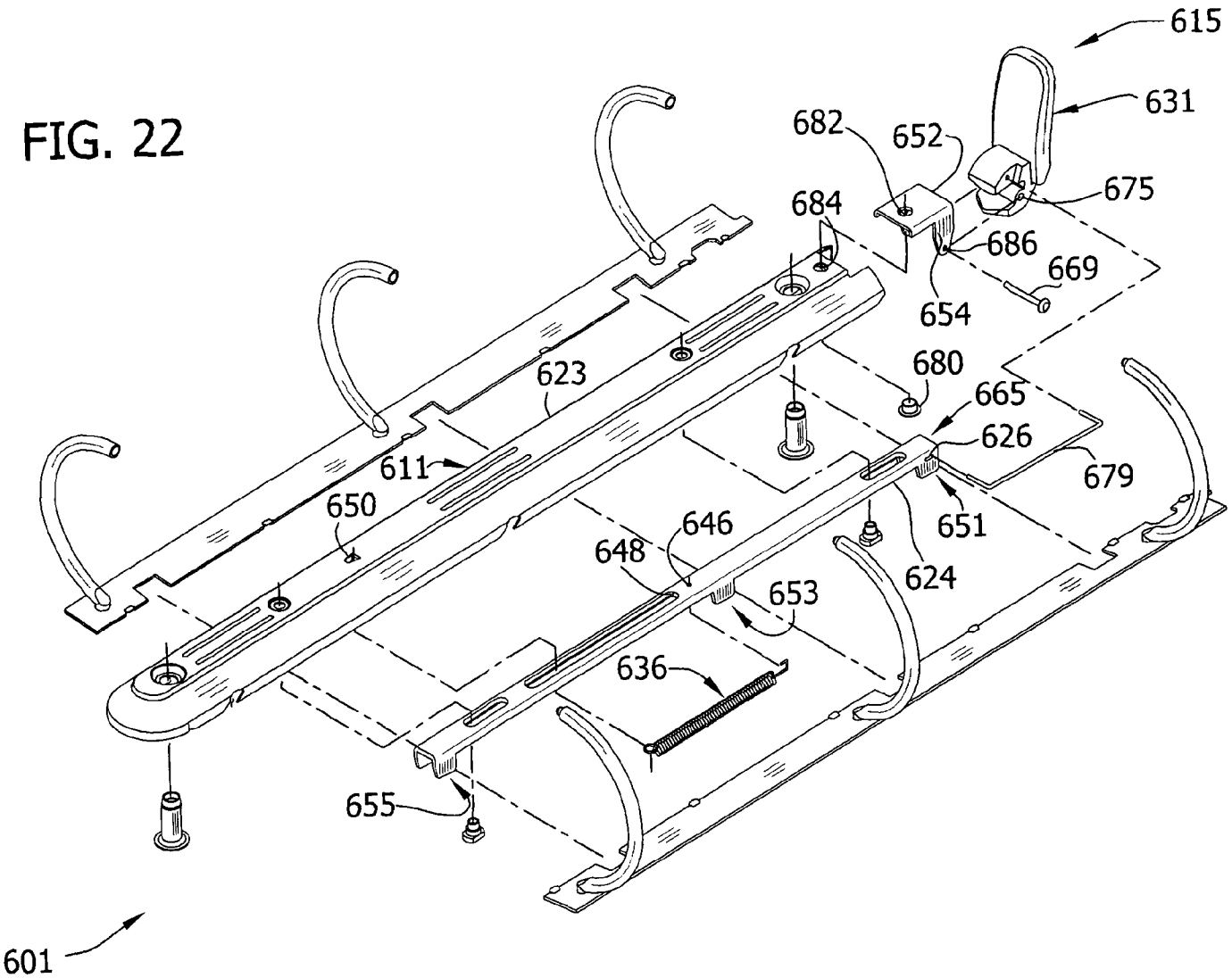
FIG. 22 is an exploded perspective of a ring binder mechanism according to a fifth embodiment of the invention.
Figure 23:
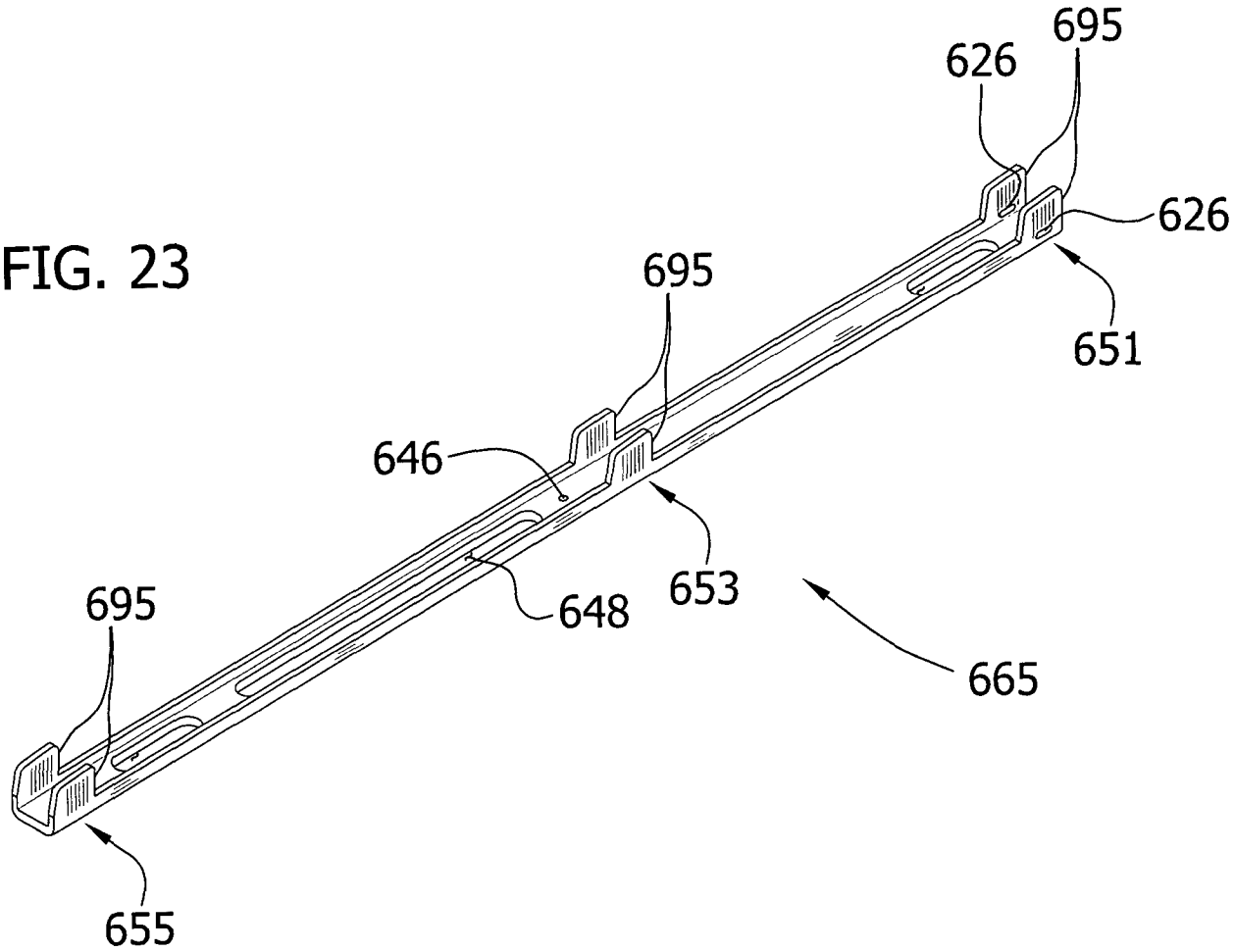
FIG. 23 is an enlarged and inverted perspective of a travel bar of the ring mechanism of FIG. 22.
Figure 24:
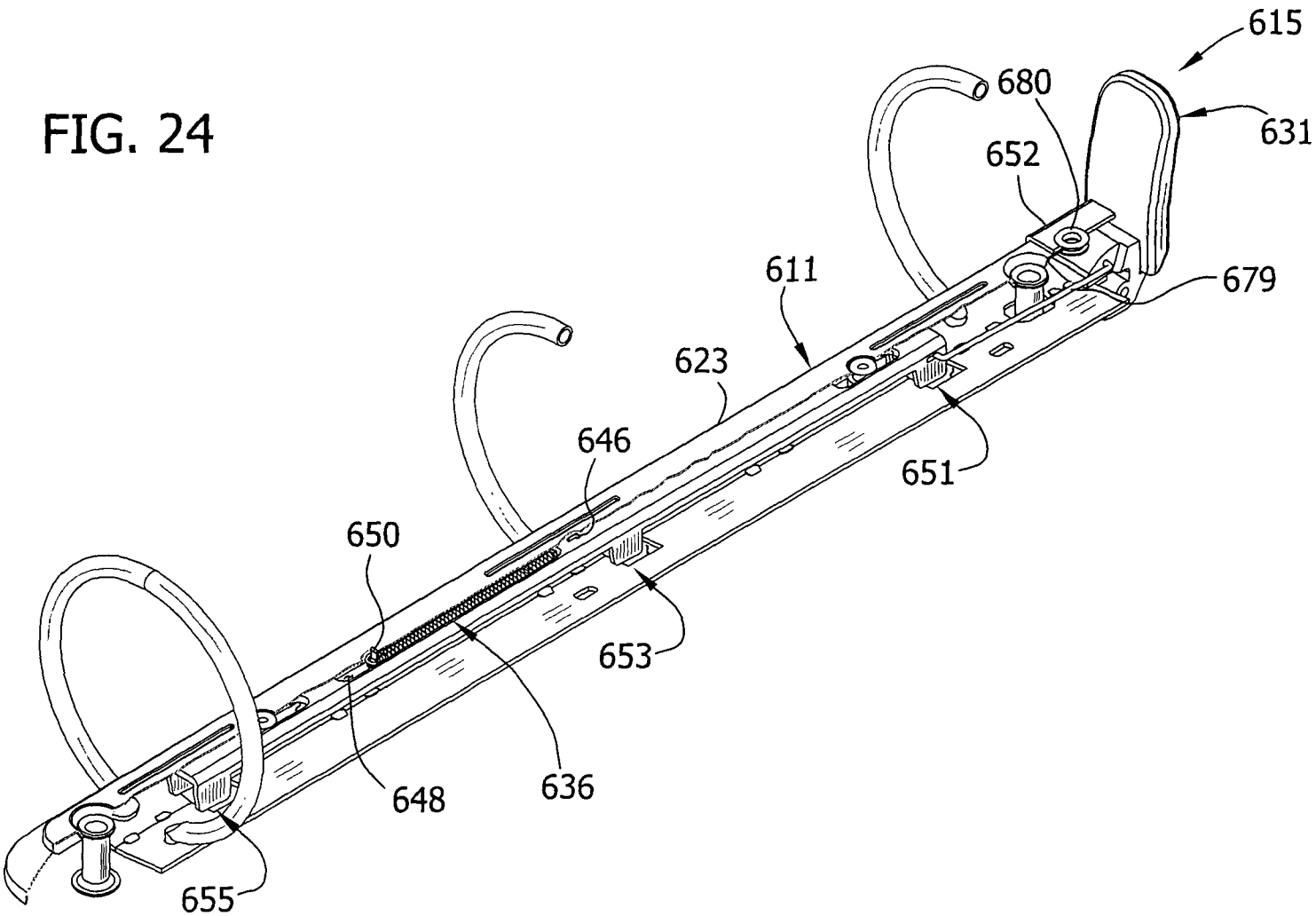
FIG. 24 is a perspective of the ring mechanism of FIG. 22 with components of the ring mechanism broken away to show internal construction.

FIGS. 22-24 show a ring binder mechanism according to a fifth embodiment of this invention. The mechanism of this embodiment is generally indicated by reference numeral 601. This embodiment is substantially similar to the fourth embodiment of FIGS. 18-21 with the exception of travel bar 665 and of orientation of coil spring 636.

As in the previous embodiments and as shown in FIGS. 22 and 23, control structure 615 of this embodiment includes lever 631, intermediate connector 679, and travel bar 665. The travel bar 665 is channel shaped with longitudinal side flanges 624 extending the length of both sides of the travel bar. Locking flanges 695 (FIG. 23) of each locking element 651, 653, 655 are formed as one piece with the travel bar side flanges 624 and project downward therefrom at uniformly spaced longitudinal intervals. There are three uniformly spaced locking flanges 695 on each side of the travel bar 665. Locking element locking flanges 695 closest the lever 631 include a slot 626 therein for receiving one end of intermediate connector 679 to connect the travel bar 665 to the lever 631.

As shown in FIG. 24, the assembled ring mechanism 601 of this embodiment is substantially similar to that of the fourth embodiment of FIGS. 18-21, with the exception that coil spring 636 attaches to the travel bar 665 and to housing 611. One end of the spring 636 attaches to the travel bar 665 at an opening 646 in the travel bar adjacent middle locking element 653 and between the middle locking element and locking element 655 farthest from the lever 631. The spring 636 extends through an elongate opening 648 in the travel bar 665, between the middle locking element 653 and end locking element 655, in a direction away from the lever 631 and attaches to the housing 611 at a detent formed in housing plateau 623.

Also in this embodiment and as shown in FIGS. 22 and 24, the lever 631 mounts on lever mount 652 separate from the housing 611, which in turn attaches to the housing. The lever mount 652 includes two downwardly projecting arms 654 (only one is visible) with aligned openings 686 therein that receive a hinge pin 669 for mounting the lever 631 through lever opening 675 on the mount. The lever mount 652 attaches to the housing 661 by a rivet 680 passing through openings 682, 684 in the mount and housing plateau 623, respectively.

Operation of the ring mechanism 601 of this embodiment is identical to that described for the ring mechanism 501 of the fourth embodiment of FIGS. 18-21.

Figure 25A:
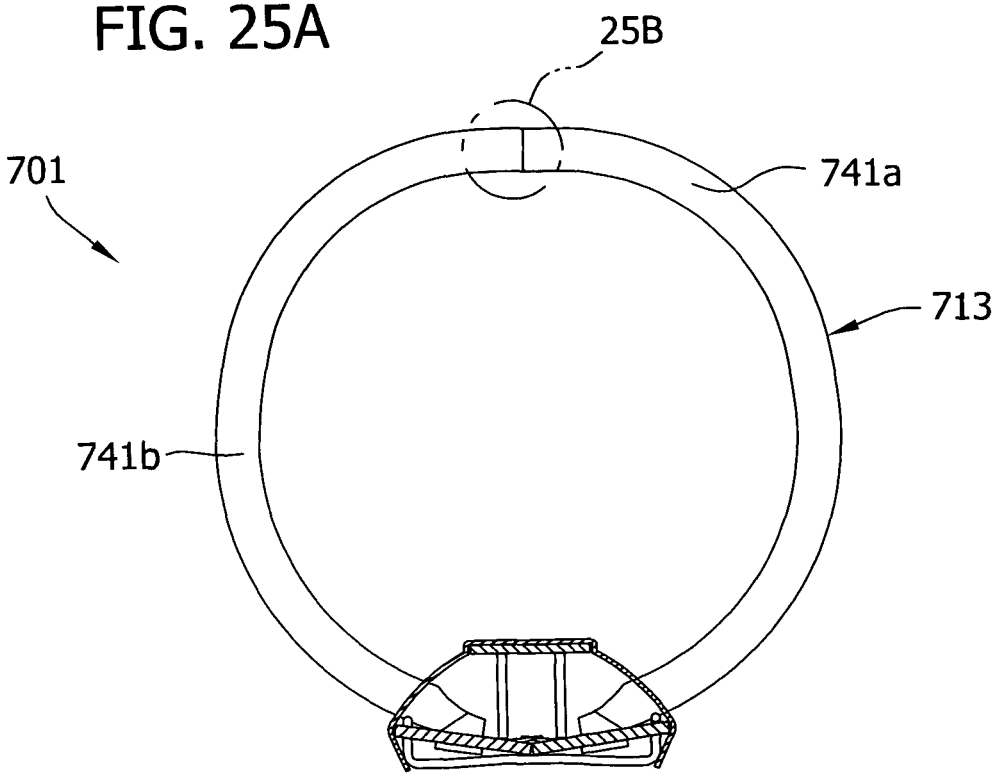
FIG. 25A is a transverse section similar to FIG. 2B showing a ring binder mechanism with ring members incorporating an alternative version of interlocking ring tip configurations of the invention.

FIGS. 25A-30 illustrate one group of alternative versions of interlocking ring tip configurations capable of being used with the ring binder mechanisms of this invention. The alternative configurations are substantially similar to the configurations 56*a*, 56*b* of the first embodiment of FIGS. 1-12. FIG. 25A illustrates a section view of a representative ring binder mechanism of this invention that is substantially the same as the ring mechanism 1 of the first embodiment of FIGS. 1-12 (specifically FIG. 2B). The mechanism is indicated generally by reference numeral 701 and will be described as incorporating interlocking ring tip configurations 756*a*, 756*b* (FIG. 25B) on ring members 741*a*, 741*b* of ring 713. It is understood that all of the alternative interlocking ring tip configurations disclosed herein could be used in ring mechanism 701.

Figure 25B:
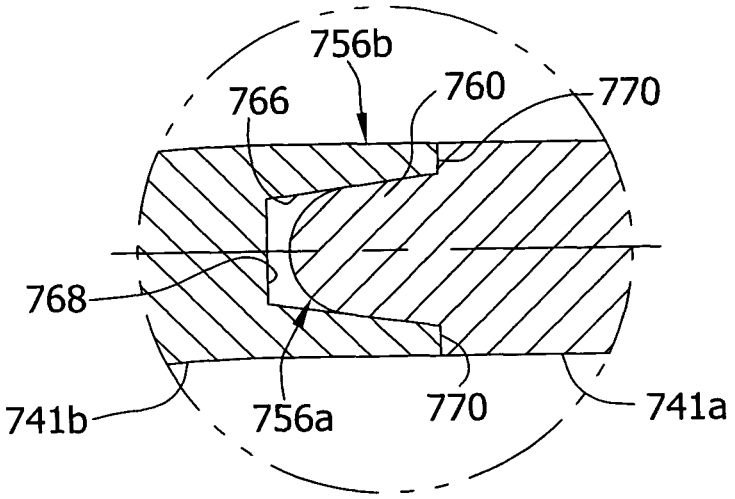
FIG. 25B is an enlarged sectional detail taken from FIG. 25A and showing the interlocking ring tip configurations of the interengaging ring members of the ring mechanism.

Interlocking ring tip configurations 756*a*, 756*b* are shown in FIG. 25B. They are substantially the same as interlocking configurations 56*a*, 56*b* of ring mechanism 1 of the first embodiment of FIGS. 1-12 (specifically FIG. 2C), with the exception of configuration 756*b*. Configuration 756*b* includes a tapered bore 766 with a substantially flat bottom 768. The bore tapers such that the diameter of the bore 766 increases, or flares, as it opens toward shoulder 770 of the configuration 756*b* at the free end of ring member 741*b*. The bore taper closely matches the taper of convex finger 760 of interlocking configuration 756*a*. This ensures that finger 760 fits snugly within the bore 766 when the ring members 741*a*, 741*b* close and prevents lateral play between the interlocking configurations 756*a*, 756*b* in their interengaged position. Accordingly, the ring members 741*a*, 741*b* are securely held in accurate alignment with their outer circumferential surfaces closely coinciding so that pages may move over the ring members without catching or tearing at the interlocking configurations 756*a*, 756*b*.

Figure 26:
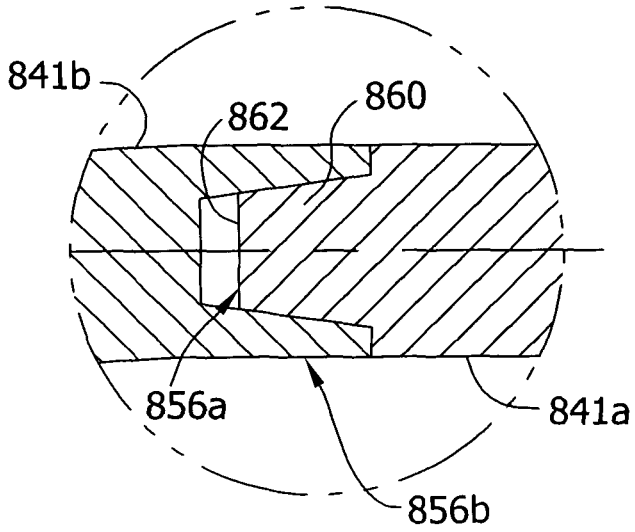
FIG. 26 is an enlarged sectional detail similar to FIG. 25B showing another alternative version of interlocking ring tip configurations of interengaging ring members.

FIG. 26 illustrates another alternative version of interlocking configurations. The configurations are designated by reference numerals 856*a*, 856*b* and are shown incorporated on ring members 841*a*, 841*b*, respectively. Configurations 856*a*, 856*b* are substantially the same as configurations 756*a*, 756*b* just described, with the exception that configuration 856*a* includes a frustoconical finger 860 having a substantially flat tip 862.

Figure 27:
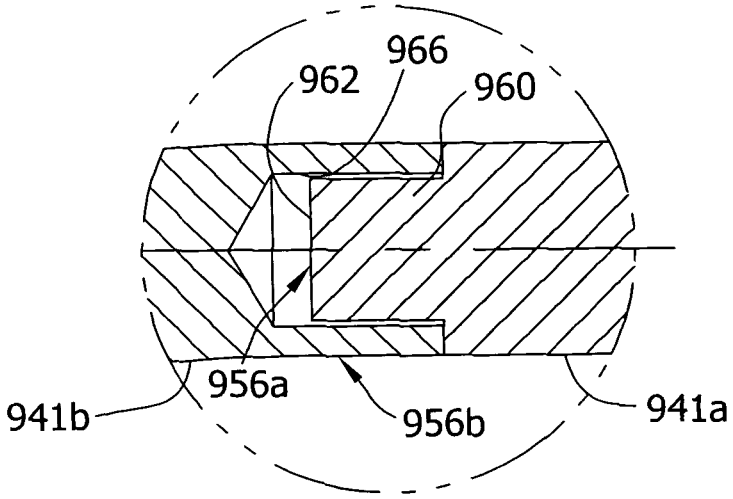
FIG. 27 is an enlarged sectional detail similar to FIG. 25B showing another alternative version of interlocking ring tip configurations of interengaging ring members.

FIG. 27 illustrates alternative interlocking configurations designated by reference numerals 956*a*, 956*b*. These configurations are shown incorporated on ring members 941*a*, 941*b*, respectively and again are substantially similar to the configurations 56*a*, 56*b* of the first embodiment of FIGS. 1-12. Here, interlocking configuration 956*a* includes a finger 960 that is substantially cylindrical, has sides that are substantially flat and do not taper, and has a substantially flat tip 962. The cylindrical shape of the finger 960 closely matches the cylindrical shape of bore 966 of interlocking configuration 956*b*. Accordingly, the two interlocking configurations 956*a*, 956*b* snugly fit together when the ring members 941*a*, 941*b* close.

Figure 28:
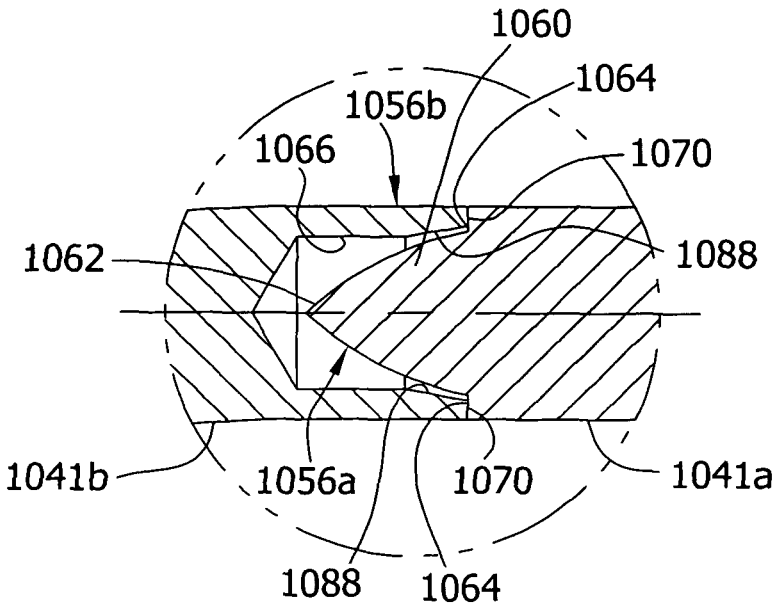
FIG. 28 is an enlarged sectional detail similar to FIG. 25B showing a further alternative version of interlocking ring tip configurations of interengaging ring members.

Another alternative version of interlocking ring tip configurations is shown in FIG. 28. The configurations are designated 1056*a*, 1056*b* and are shown incorporated on ring members 1041*a*, 1041*b*, respectively. The configurations 1056*a*, 1056*b* are substantially the same as the configurations 56*a*, 56*b* of the first embodiment of FIGS. 1-12 with the exception that interlocking configuration 1056*a* includes a generally conical finger 1060 with a pointed tip 1062 and configuration 1056*b* includes a bore 1066 with a circumferential chamfer 1088 adjacent shoulder 1070. Sides of finger 1060 are slightly arced as they extend from shoulder 1064 of the configuration 1056*a* to tip 1062. The conical finger 1060 and chamfer 1088 of the bore 1066 improve the interengagement between the interlocking configurations 1056*a*, 1056*b*. In particular, they improve the ability of the interlocking configurations 1056*a*, 1056*b* to cam misaligned ring members into alignment.

Figure 29:
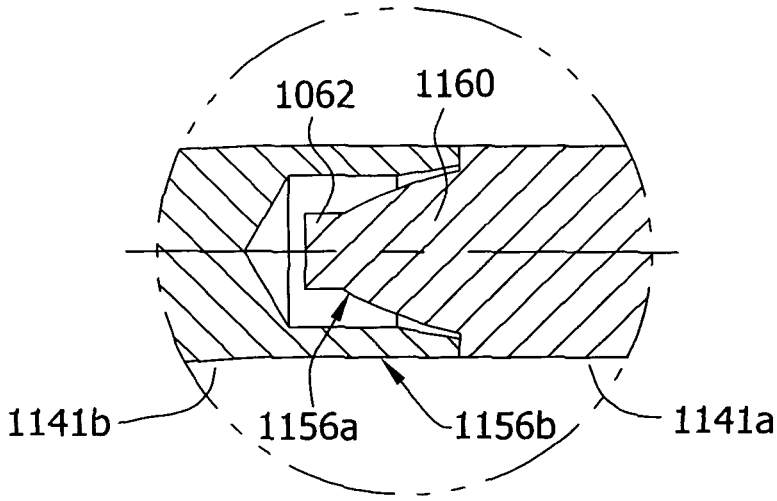
FIG. 29 is an enlarged sectional detail similar to FIG. 25B showing still another alternative version of interlocking ring tip configurations of interengaging ring members.

FIG. 29 shows another pair of interlocking ring tip configurations, which are designated 1156*a*, 1156*b* and are shown incorporated on ring members 1141*a*, 1141*b*, respectively. The configurations 1156*a*, 1156*b* are substantially the same as the configurations 1056*a*, 1056*b* just described (FIG. 28) with the exception of interlocking configuration 1156*a*, which includes a generally conical finger 1160 with a cylindrical tip 1162. The cylindrical tip 1162 is relatively blunt and helps prevent injury to an operator if a finger is inadvertently placed between closing ring members 1141*a*, 1141*b*.

Figure 30:
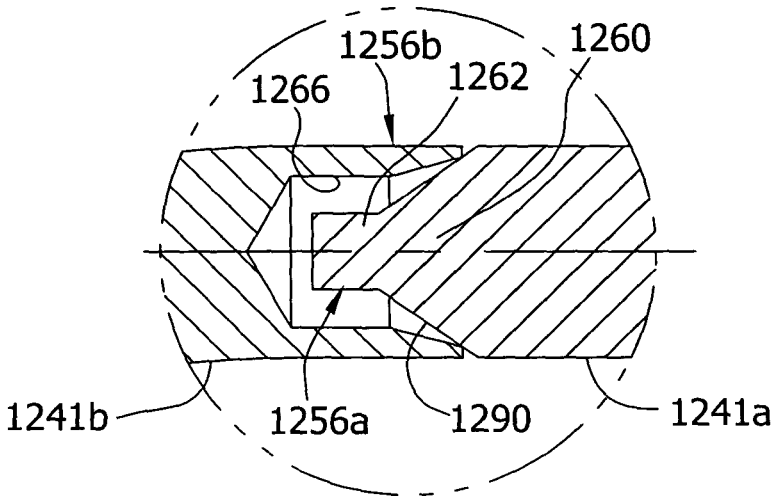
FIG. 30 is an enlarged sectional detail similar to FIG. 25B showing still a further alternative version of interlocking ring tip configurations of interengaging ring members.

Still another version of interlocking ring tip configurations is shown in FIG. 30. The configurations are designated by reference numerals 1256*a*, 1256*b* and are shown incorporated on ring members 1241*a*, 1241*b*, respectively. These configurations are substantially the same as the configurations 1156*a*, 1156*b* just described (FIG. 29), with the exception of configuration 1256*a*. Configuration 1256*a* includes a generally conical-shaped finger 1260 with a cylindrical-shaped tip 1162. The finger 1260 has a circumferential side surface 1290 that extends from an outer surface of the ring member 1241*a* to the cylindrical tip 1262. The side surface 1290 improves interengagement between the finger 1260 of configuration 1256*a* and bore 1266 of configuration 1256*b*. Since the finger surface 1290 extends from the outer surface of the ring member 1241*a*, the configuration 1256*a* tightly wedges into the bore 1266 of configuration 1256*b* and securely holds the two configurations together. This improves resistance to lateral separation of the ring members 1241*a*, 1241*b* and disengagement of their interlocking configurations 1256*a*, 1256*b*.

FIGS. 31-35 illustrate a second group of alternative interlocking ring tip configurations capable of being used with ring binder mechanisms of the invention. These configurations are substantially similar to the interlocking configurations disclosed in co-owned U.S. patent application Ser. No. 10/967,882, filed Oct. 18, 2004, and entitled Interlocking Ring Tip Formations for Paired Ring Members of a Ring Binder Mechanism, the entire disclosure of which has been incorporated by reference.

Figure 31:
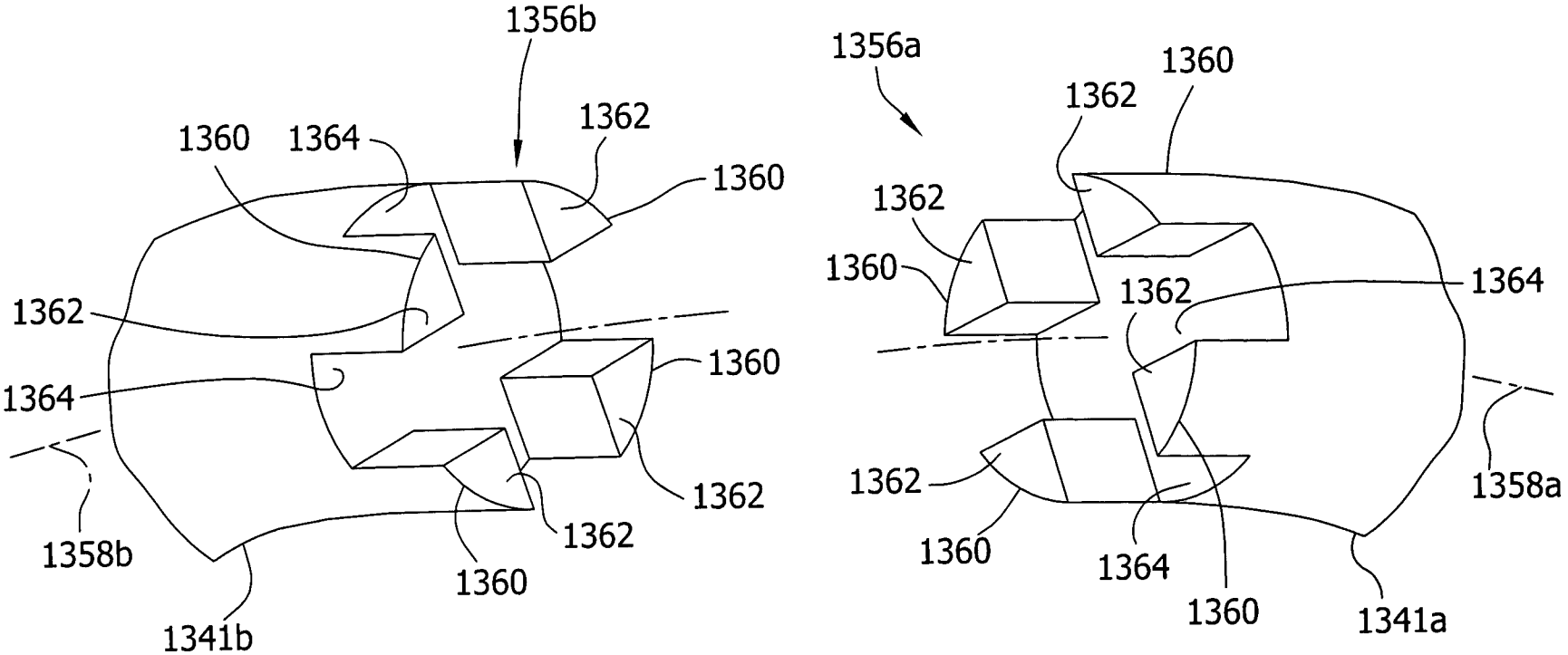
FIG. 31 is an enlarged perspective view showing an alternative version of interlocking ring tip configurations of interengaging ring members that are capable of being used with the ring mechanism of FIG. 25A.

FIG. 31 shows a first of these interlocking ring tip configurations at reference numerals 1356*a*, 1356*b* incorporated on ring members 1341*a*, 1341*b*, respectively. Configuration 1356*a* has substantially the same shape as configuration 1356*b*. Only configuration 1356*a* will be described with it understood that a description of configuration 1356*b* is substantially the same. Configuration 1356*a* includes two channels, each designated 1364, that uniformly extend along diameters of the free end of ring member 1341*a*. The recesses 1364 intersect at a right angle near a center of the ring member's free end. Configurations with recesses oriented differently than disclosed herein do not depart from the scope of the invention.

The intersecting recesses 1364 divide the free end of ring member 1341*a* into four substantially identical and spaced apart triangular fingers, each designated 1360. The fingers 1360 are uniformly spaced around a perimeter of the ring member's free end so that an arcuate outer surface of each finger 1360 is a continuous extension of the outer surface of the ring member 1341*a*. The fingers 1360 project from the free end of the ring member 1341*a* at an angle of about 90 degrees and terminate at a substantially flat tip.

It can be seen in FIG. 31 that interlocking configuration 1356*b* is rotated an angle of about 45 degrees about its centerline 1358*b* relative to interlocking configuration 1356*a*. This relative rotation provides a complementary fit when the ring members 1341*a*, 1341*b* move to their closed position. Fingers 1360 of one configuration accurately fit within recesses 1364 of the interengaging configuration so that when the ring members 1341*a*, 1341*b* close, they completely align in all directions transverse to their centerlines 1358*a*, 1358*b*. In the illustrated embodiment the relative rotation is about 45 degrees, but it is understood that interlocking configurations oriented differently (e.g., a first interlocking configuration rotated an angle different from 45 degrees about a longitudinal centerline of its ring member relative to a second interlocking configuration) does not depart from the scope of the invention. More generally, the angle of relative rotation is about equal to 180 degrees divided by the number of finger tips of the interlocking formation.

Figure 32:
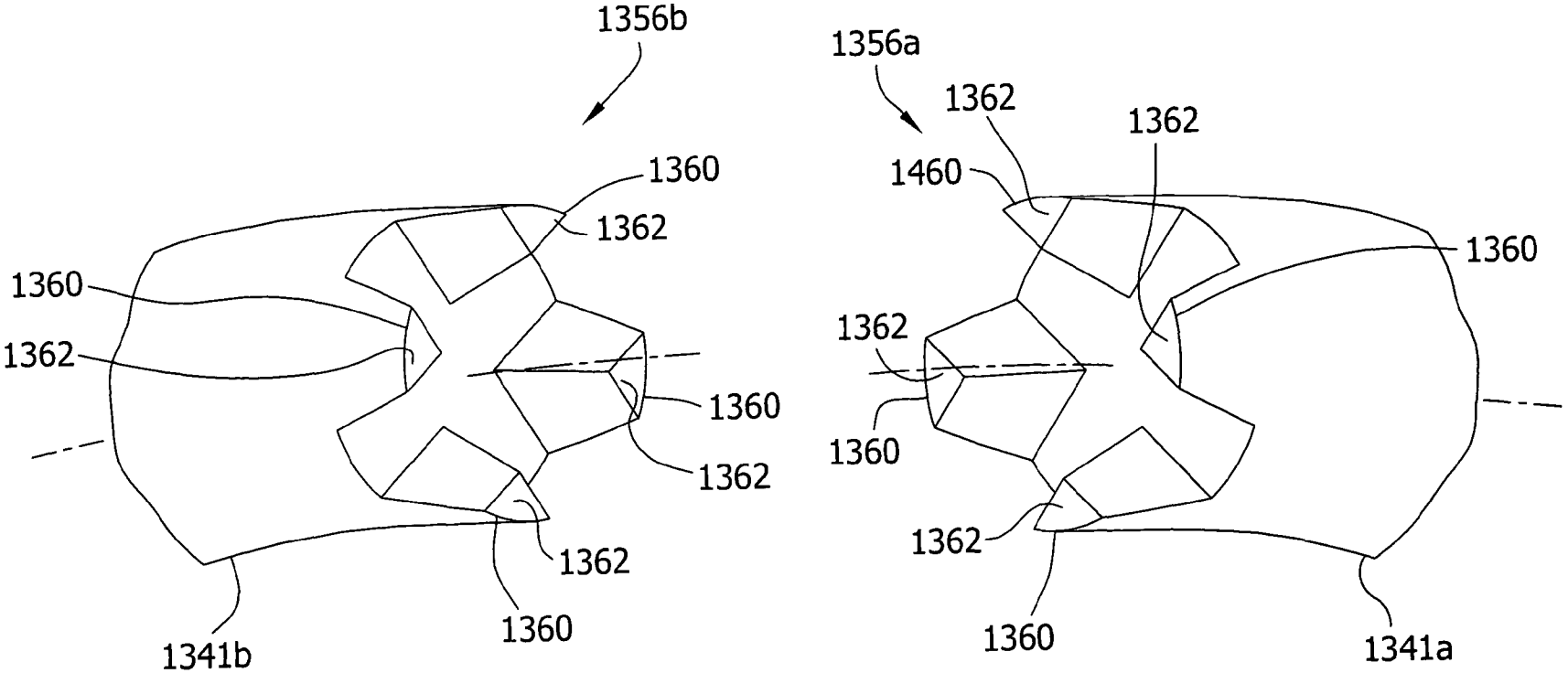
FIG. 32 is an enlarged perspective showing another alternative version of interlocking ring tip configurations of interengaging ring members.
Figure 33:
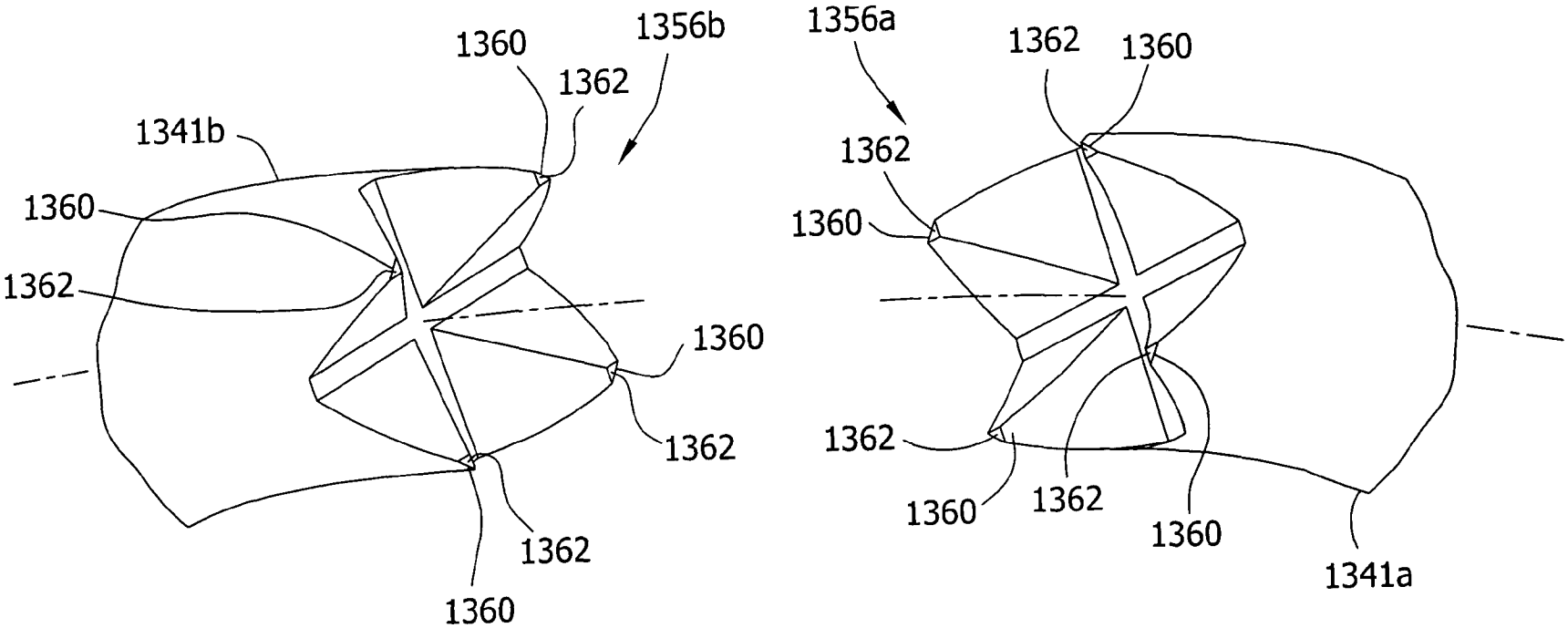
FIG. 33 is an enlarged perspective showing a further alternative version of interlocking ring tip configurations.

FIGS. 32 and 33 show substantially similar interlocking configurations to the configurations 1356*a*, 1356*b* of FIG. 31. In the configurations of FIGS. 32 and 33, however, fingers 1360 project from the free ends of ring members 1341*a*, 1341*b* at angles greater than 90 degrees (i.e., sides of the fingers 1360 taper generally toward their respective finger tips 1362). As seen by comparing FIGS. 32 and 33, fingers 1360 of the interlocking configurations 1356*a*, 1356*b* of FIG. 33 taper significantly more than do the fingers 1360 of the corresponding interlocking configurations 1356*a*, 1356*b* of FIG. 32. Fingers 1360 of the configurations of FIG. 33 are substantially pointed (FIG. 33).

Figure 34:
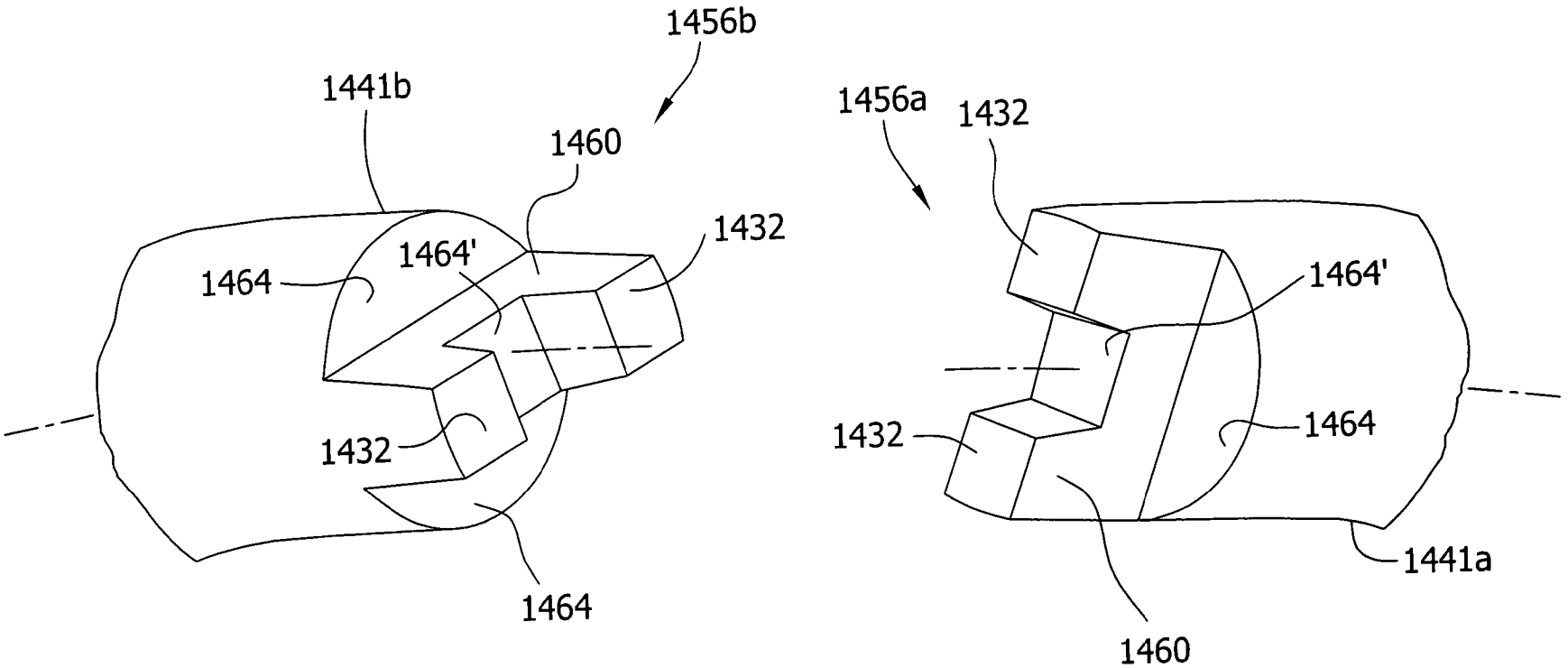
FIG. 34 is an enlarged perspective showing still another alternative version of interlocking ring tip configurations.

FIG. 34 shows another pair of alternative interlocking ring tip configurations. The configurations are designated by reference numerals 1456*a*, 1456*b* and are shown incorporated on ring members 1441*a*, 1441*b*. The two configurations again each have substantially similar shapes, and only one configuration will be described with it understood that a description of the other configuration is the same. Configuration 1456*a* includes a fork-shaped finger 1460 extending along a diameter of the free end of ring member 1441*a*. The finger 1460 divides the free end into two identical shoulders 1464. It projects from the free end and tapers generally toward two spaced apart finger tips 1432 projecting from the finger 1460. The tips 1432 are substantially identical in size and shape and have substantially flat tops. Each tip 1432 is located adjacent a perimeter of the ring member 1441*a* so that an arcuate outer surface of each tip 1432 is a continuous extension of the outer surface of the ring member 1441*a*. In this orientation, a central, shallow valley 1464' is formed between the tips near the center of the ring member's free end.

As can be seen, interlocking configuration 1456*b* is rotated an angle of about 90 degrees about longitudinal centerline 1458*b* relative to configuration 1456*a*. This relative rotation again provides a complementary fit between the interlocking configurations 1456*a*, 1456*b* when the ring members 1441*a*, 1441*b* move to their closed position. The interlocking configurations 1456*a*, 1456*b* securely hold the ring members together when they close against misalignment in directions transverse to centerlines 1458*a*, 1458*b*.

Figure 35:
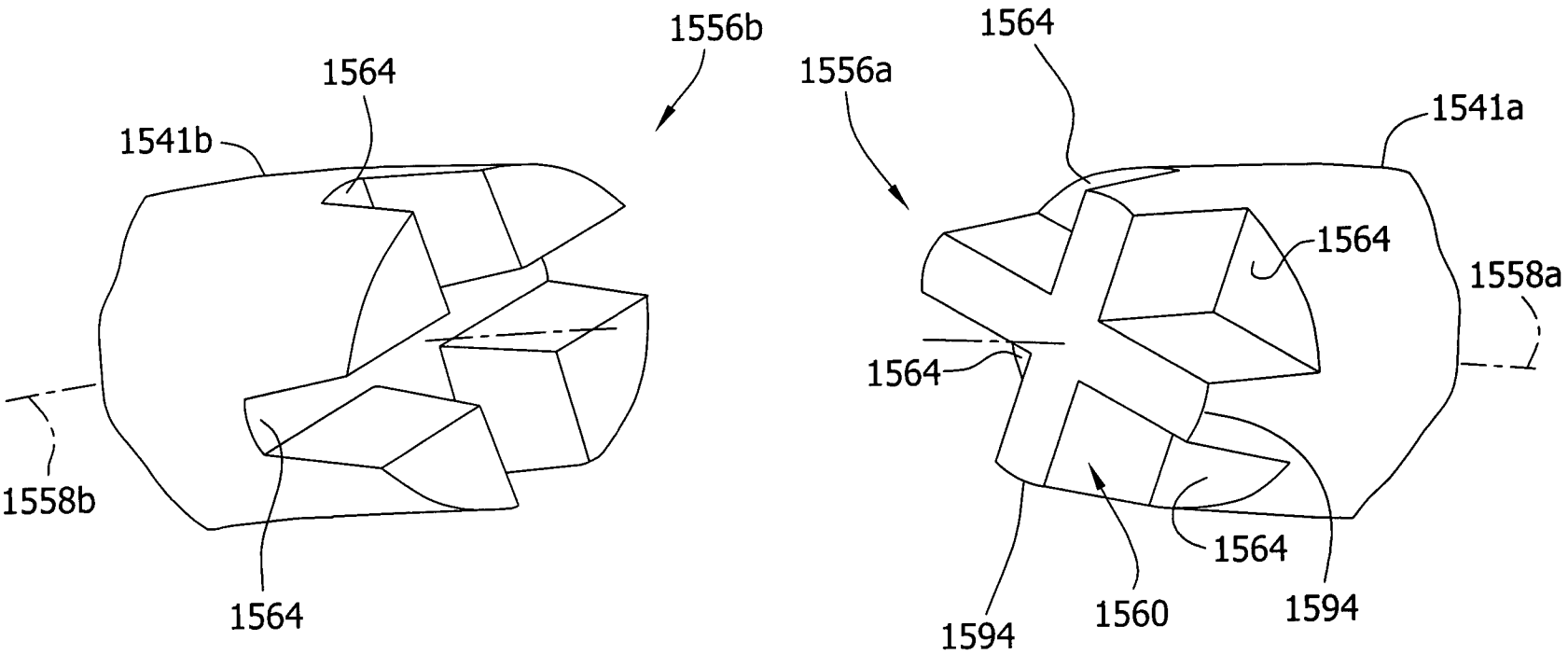
FIG. 35 is an enlarged perspective showing still a further alternative version of interlocking ring tip configurations.

FIG. 35 shows a pair of alternative interlocking ring tip configurations at reference numerals 1556*a*, 1556*b*. The configurations are shown incorporated on ring members 1541*a*, 1541*b*. Configuration 1556*b* is substantially the same as configurations 1356*a*, 1356*b* of FIG. 31. However, configuration 1556*a* alternatively includes a cruciform finger 1560 projecting from the free end of ring member 1541*a*. The finger 1560 is symmetrically located on the free end and includes two arms 1594 oriented along diameters of the surface of the ring member's free end. The arms intersect at an angle of about 90 degrees near a center of the free end and divide the free end into four uniform, recessed surfaces 1564 around the perimeter of the free end.

The shape of the cruciform finger 1560 closely matches the shape of the intersecting recesses 1564 of configuration 1556*b*. When ring members 1541*a*, 1541*b* close, the finger 1560 of configuration 1556*a* accurately fits within the recesses 1564 of configuration 1556*b*. This again holds closed ring members 1541*a*, 1541*b* together against misalignment in directions transverse to their longitudinal centerlines 1558*a*, 1558*b*.

Components of the mechanism of the present invention according to the several discussed embodiments are made of a suitable rigid material, such as metal (e.g., steel). But mechanisms made of a nonmetallic material, specifically including plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations thereof is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing;

hinge plates supported by the housing for pivoting motion about a pivot axis relative to the housing;

rings for holding loose-leaf pages, each ring including first and second ring members, the first ring member being mounted on a first hinge plate and moveable with the pivoting motion of the first hinge plate relative to the second ring member so that in a closed position a free end of the first ring member joins with a free end of the second ring member and in an open position the free end of the first ring member separates from the free end of the second ring member, each ring member including a longitudinal centerline;

the free end of the first ring member having an interlocking configuration having a first shape and the free end of the second ring member having an interlocking configuration having a second shape adapted to interengage with the interlocking configuration of the first ring member to block movement of the first and second ring members relative to each other in all directions transverse to the longitudinal centerlines of the ring members when the ring members are in their closed position; and a control structure supported by the housing and movable relative to the housing, the control structure resisting separation of the free ends of the ring members when the ring members are in their closed position.

2. The ring binder mechanism as set forth in claim 1 wherein at least one of the interlocking configurations is constructed for reception in the other of the interlocking configurations.

3. The ring binder mechanism as set forth in claim 2 wherein the interlocking configuration of the free end of the first ring member comprises a recess and the interlocking configuration of the free end of the second ring member comprises a projection adapted to be received in the recess in the closed position.

4. The ring binder mechanism as set forth in claim 3 wherein the recess flares outwardly at the free end of the first ring member, and the projection tapers toward a tip thereof whereby the recess and projection are configured to align the centerlines of the first and second ring members when the ring members move to the closed position.

5. The ring binder mechanism as set forth in claim 4 wherein the recess is symmetrical about the longitudinal centerline of the first ring member and the projection is symmetrical about the longitudinal centerline of the second ring member.

6. The ring binder mechanism as set forth in claim 4 wherein the control structure comprises at least one locking element engageable with at least one of the hinge plates in the closed position for blocking pivoting motion of the hinge plates to the open position.

7. The ring binder mechanism as set forth in claim 6 wherein the control structure comprises three locking elements.

8. The ring binder mechanism as set forth in claim 6 wherein the control structure further comprises a travel bar mounted for movement generally lengthwise of the housing, the locking element being associated with the travel bar for movement therewith, the locking element engaging the hinge plates and blocking the pivoting motion of the hinge plates when the ring members are in their closed position.

9. The ring binder mechanism as set forth in claim 8 wherein the locking element is disposed between the hinge plates and the housing in the closed position for preventing upward pivoting motion of the hinge plates to the open position.

10. The ring binder mechanism as set forth in claim 9 wherein the hinge plates define at least one opening, the locking element being substantially in registration with the opening in the open position.

11. The ring binder mechanism as set forth in claim 1 wherein the control structure comprises at least one locking element engageable with at least one of the hinge plates in the closed position for blocking pivoting motion of the hinge plates to the open position.

12. The ring binder mechanism set forth in claim 11 wherein the control structure further comprises a travel bar mounted for movement generally lengthwise of the housing, the locking element being associated with the travel bar for movement therewith, the locking element engaging the hinge plates and blocking the pivoting motion of the hinge plates when the ring members are in their closed position.

13. The ring binder mechanism as set forth in claim 12 wherein the locking element is disposed between the hinge plates and the housing in the closed position for preventing upward pivoting motion of the hinge plates to the open position.

14. The ring binder mechanism as set forth in claim 13 wherein the hinge plates define at least one opening, the locking element being substantially in registration with the opening in the open position.

15. The ring binder mechanism as set forth in claim 1 wherein the shape of the interlocking configuration of the first ring member is substantially identical to the shape of the interlocking configuration of the second ring member, the interlocking configuration of the second ring member being rotated about the longitudinal centerline of the second ring member relative to the interlocking configuration of the first ring member.

16. The ring binder mechanism as set forth in claim 15 wherein the interlocking configurations comprise a plurality of finger tips and the relative angle of rotation between the interlocking configurations generally equals 180 degrees divided by the number of finger tips of one of the interlocking configurations.

17. The ring binder mechanism as set forth in claim 1 wherein the interlocking configuration of the first ring member includes at least one arm extending along a surface of the ring member's free end transversely to the longitudinal centerline of the respective ring member and the interlocking configuration of the second ring member includes at least one recess, the recess of the second ring member being adapted to receive the arm of the first ring member.

18. The ring binder mechanism as set forth in claim 1 in combination with a cover, the ring binder mechanism being mounted on the cover, the cover being hinged for movement to selectively cover and expose loose-leaf pages retained on the ring binder mechanism.

* * * * *